US007524399B2

(12) United States Patent
Hermans et al.

(10) Patent No.: US 7,524,399 B2
(45) Date of Patent: Apr. 28, 2009

(54) MULTIPLE PLY TISSUE PRODUCTS HAVING ENHANCED INTERPLY LIQUID CAPACITY

(75) Inventors: Michael Alan Hermans, Neenah, WI (US); James Monroe Perkins, Appleton, WI (US); Young Ko, Neenah, WI (US); Arvinder Pal Singh Kainth, Neenah, WI (US); Laura Leigh Boudrie, Appleton, WI (US); James Leo Baggot, Menasha, WI (US); Michael John Smith, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 594 days.

(21) Appl. No.: 11/020,553

(22) Filed: Dec. 22, 2004

(65) Prior Publication Data

US 2006/0130988 A1 Jun. 22, 2006

(51) Int. Cl.

| | |
|---|---|
| ***D21H 27/30*** | (2006.01) |
| ***B32B 3/00*** | (2006.01) |
| ***B32B 7/12*** | (2006.01) |
| ***B32B 29/00*** | (2006.01) |

(52) U.S. Cl. ..... 162/123; 162/117; 162/118; 428/172; 428/156

(58) Field of Classification Search ..... 162/123–133, 162/117–118, 109, 615, 537.5, 172, 156; 428/537.5, 615, 172, 156

See application file for complete search history.

(56) References Cited

U.S. PATENT DOCUMENTS

| | | | | |
|---|---|---|---|---|
| 3,300,368 | A * | 1/1967 | Cooper et al. | 428/153 |
| 3,585,104 | A | 6/1971 | Kleinert | |
| 4,166,001 | A | 8/1979 | Dunning et al. | |
| 4,196,045 | A | 4/1980 | Ogden | |
| 4,300,981 | A | 11/1981 | Carstens | |
| 4,594,130 | A | 6/1986 | Chang et al. | |
| 4,793,898 | A | 12/1988 | Laamanen et al. | |
| 5,048,589 | A | 9/1991 | Cook et al. | |
| 5,059,282 | A | 10/1991 | Ampulski et al. | |
| 5,129,988 | A | 7/1992 | Farrington, Jr. | |
| 5,164,045 | A | 11/1992 | Awofeso et al. | |
| 5,399,412 | A | 3/1995 | Sudall et al. | |
| 5,409,572 | A | 4/1995 | Kershaw et al. | |
| 5,429,686 | A | 7/1995 | Chiu et al. | |
| 5,494,554 | A | 2/1996 | Edwards et al. | |
| 5,562,805 | A | 10/1996 | Kamps et al. | |
| 5,595,628 | A | 1/1997 | Gordon et al. | |
| 5,607,551 | A | 3/1997 | Farrington, Jr. et al. | |
| 5,656,132 | A | 8/1997 | Farrington, Jr. et al. | |
| 5,672,248 | A | 9/1997 | Wendt et al. | |
| 5,702,571 | A | 12/1997 | Kamps et al. | |
| 5,772,845 | A | 6/1998 | Farrington, Jr. et al. | |
| 5,846,380 | A | 12/1998 | Van Phan et al. | |
| 5,904,812 | A | 5/1999 | Salman et al. | |
| 5,932,068 | A | 8/1999 | Farrington, Jr. et al. | |
| 5,958,185 | A | 9/1999 | Vinson et al. | |
| 6,030,496 | A | 2/2000 | Baggot et al. | |
| 6,033,523 | A | 3/2000 | Dwiggins et al. | |
| 6,077,390 | A | 6/2000 | Salman et al. | |
| 6,077,590 | A | 6/2000 | Archer et al. | |
| 6,162,327 | A | 12/2000 | Batra et al. | |
| 6,171,442 | B1 | 1/2001 | Farrington, Jr. et al. | |
| 6,183,599 | B1 | 2/2001 | Oriaran et al. | |
| 6,187,137 | B1 * | 2/2001 | Druecke et al. | 162/111 |
| 6,200,419 | B1 | 3/2001 | Phan | |
| 6,267,975 | B1 | 7/2001 | Smith, III et al. | |
| 6,270,878 | B1 | 8/2001 | Wegele et al. | |
| 6,277,466 | B1 | 8/2001 | McNeil et al. | |
| 6,344,111 | B1 | 2/2002 | Wilhelm | |
| 6,372,087 | B2 | 4/2002 | Harper et al. | |

(Continued)

FOREIGN PATENT DOCUMENTS

| | | | |
|---|---|---|---|
| EP | 0909357 | B1 | 4/1999 |
| EP | 1325981 | A1 | 7/2003 |
| EP | 1327716 | A1 * | 7/2003 |
| EP | 1632604 | A1 * | 3/2006 |
| GB | 2304123 | A | 3/1997 |
| WO | WO 9842289 | A1 * | 10/1998 |
| WO | WO 0008253 | A1 | 2/2000 |
| WO | WO 0185438 | A2 | 11/2001 |
| WO | WO0240260 | A2 | 5/2002 |
| WO | WO 0240774 | A2 | 5/2002 |
| WO | WO 0240774 | A3 | 5/2002 |
| WO | WO 2006071287 | A1 * | 7/2006 |

OTHER PUBLICATIONS

Hermans, et al., U.S. Appl. No. 10/700,379, filed Nov. 3, 2003, Rolled Tissue Products Having High Buk, Softness And Firmness.

Search Report and Written Opinion for PCT/US2005/029475.

*Primary Examiner*—José A Fortuna
(74) *Attorney, Agent, or Firm*—Dority & Manning, P.A.

(57) ABSTRACT

Multi-ply tissue products are disclosed. The multi-ply tissue products contain tissue webs that have raised areas and depressed areas. The tissue webs may be constructed so as to be relatively non-compressive and may have a resilient three-dimensional structure. During production, in one embodiment, the tissue webs may be produced without being subjected to any substantial compression, such as a calendering process. Although not necessary in all applications, in one embodiment, the tissue webs may be combined such that the depressed areas contact each other to form the multi-ply product. The tissue webs, for instance, may comprise a through-air dried web in which the raised areas and the depressed areas are molded into the web. Tissue products made according to the present invention have enhanced absorption characteristics. For instance, the tissue products can have an interply absorbency of greater than about 3 g/g after 30 seconds.

36 Claims, 16 Drawing Sheets

U.S. PATENT DOCUMENTS

| | | | | |
|---|---|---|---|---|
| 6,395,133 | B1 | 5/2002 | McNeil | |
| 6,395,957 | B1 | 5/2002 | Chen et al. | |
| 6,423,180 | B1 | 7/2002 | Behnke et al. | |
| 6,436,234 | B1 | 8/2002 | Chen et al. | |
| 6,440,268 | B1 | 8/2002 | Baggot et al. | |
| 6,458,450 | B1 | 10/2002 | Steinhardt et al. | |
| 6,468,392 | B2 | 10/2002 | Oriarian et al. | |
| 6,547,926 | B2 | 4/2003 | Drew et al. | |
| 6,572,722 | B1 | 6/2003 | Pratt | |
| 6,585,855 | B2 | 7/2003 | Drew et al. | |
| 6,602,387 | B1 | 8/2003 | Loughran et al. | |
| 6,607,635 | B2 | 8/2003 | Bakken et al. | |
| 6,607,638 | B2 | 8/2003 | Drew et al. | |
| 6,613,193 | B2 | 9/2003 | Wolkowicz et al. | |
| 6,649,024 | B2 | 11/2003 | Oriarian et al. | |
| 6,676,807 | B2 | 1/2004 | Hada et al. | |
| 6,712,930 | B2 | 3/2004 | Koivukunnas | |
| 6,716,308 | B2 | 4/2004 | Baggot et al. | |
| 6,746,570 | B2 | 6/2004 | Burazin et al. | |
| 6,911,573 | B2 * | 6/2005 | Chen et al. | 604/378 |
| 7,179,951 | B2 * | 2/2007 | Krishnaswamy-Mirle et al. | 604/378 |
| 7,211,171 | B2 * | 5/2007 | Reinheimer et al. | 162/117 |
| 2003/0106657 | A1 | 6/2003 | Baggot | |
| 2004/0050516 | A1 | 3/2004 | Koivukunnas | |
| 2004/0101704 | A1 | 5/2004 | Hermans et al. | |
| 2004/0140076 | A1 | 7/2004 | Hermans et al. | |
| 2004/0250969 | A1 * | 12/2004 | Luu et al. | 162/123 |
| 2005/0045293 | A1 * | 3/2005 | Hermans et al. | 162/109 |
| 2005/0145353 | A1 | 7/2005 | Troxell et al. | |
| 2005/0247416 | A1 * | 11/2005 | Forry et al. | 162/109 |
| 2005/0274470 | A1 * | 12/2005 | Shannon et al. | 162/125 |
| 2006/0130988 | A1 * | 6/2006 | Hermans et al. | 162/123 |
| 2008/0029235 | A1 * | 2/2008 | Edwards et al. | 162/111 |

* cited by examiner

MULTIPLE PLY TISSUE PRODUCTS HAVING ENHANCED INTERPLY LIQUID CAPACITY

BACKGROUND OF THE INVENTION

In the manufacture of tissue products such as bath tissue, a wide variety of product characteristics must be given attention in order to provide a final product with the appropriate blend of attributes suitable for the product's intended purposes. Improving the softness of tissues is a continuing objective in tissue manufacture, especially for premium products. Softness, however, is a perceived property of tissues comprising many factors including thickness, smoothness, and fuzziness.

Traditionally, tissue products have been made using a wet-pressing process in which a significant amount of water is removed from a wet-laid web by pressing the web prior to final drying. In one embodiment, for instance, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping generally improves the softness of the web, albeit at the expense of a loss in strength.

Recently, throughdrying has increased in popularity as a means of drying tissue webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is at least almost completely dry. The resulting dried web is softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

Even more recently, significant advances have been made in high bulk sheets as disclosed in U.S. Pat. Nos. 5,607,551; 5,772,845; 5,656,132; 5,932,068; and 6,171,442, which are all incorporated herein by reference. These patents disclose soft throughdried tissues made without the use of a Yankee dryer. The typical Yankee functions of building machine direction and cross-machine direction stretch are replaced by a wet-end rush transfer and the throughdrying fabric design, respectively.

Although the above-identified U.S. patents have provided great advances in the art, further improvements are still desired, especially with respect to increasing bulk and absorbency of the products without compromising strength. For example, in order to achieve higher bulk and absorbency in multi-ply tissue products, in the past, the individual plies have been embossed prior to bonding the plies together. Unfortunately, however, embossing the tissue webs may degrade the strength of the overall product. The embossing process also requires an additional process step that tends to increase the overall cost of the product and lower the rate at which the product is made.

In view of the above, a need currently exists for an improved multi-ply tissue product with enhanced bulk and absorbency characteristics.

DEFINITIONS

A tissue product as described in this invention is meant to include paper products made from base webs such as bath tissues, facial tissues, paper towels, industrial wipers, food-service wipers, napkins, medical pads, and other similar products.

As used herein total absorbency is measured according to the following test. The GATs (Gravimetric Absorbency Tester) is used for the absorbency test and is commercially available from the M/K system. The testing procedure is described by TAPPI (Technical Association of Pulp and Paper Industries).

In the conventional absorbency measurements, GATs uses the flat and flat plate configuration which is likely to induce the channeling of water between the plate and the sample, which may result in an erroneous result. So, in this present invention, to eliminate this error, the recessed-recessed plate configuration was used to determine total absorbency. Such configuration is schematically shown in FIG. 3. To distinguish from the GATS measurements, this modified configuration is referred to as AGATS (automatic gravimetric absorbency tester).

In AGAT with the sample holder in a recessed/recessed configuration, the majority of the sample area does not come in contact with solid surfaces. Non-contact between the sample and any solid surface prevents over-saturation, excess fluid flow, and surface wicking; thereby eliminating artificial effects.

The sample comprises a 2.5-cm radius circular specimen die-cut from a single sheet of product. The sample 102 is placed on a plate 104 that is recessed throughout the sample area, with the exception of the specimen's outer edge and a small "stub" in the center containing a port 106 leading from a fluid reservoir. A top recessed plate 100, symmetrical to the bottom recessed plate 104, is placed onto the outer edge of the specimen to hold it in place. The sample 102 sits just above the reservoir fluid level, which is kept constant between tests. To start the test, the plate 104 is moved automatically downward just far enough to force a small amount of fluid through the port 106, out of the plate stub, and in contact with the sample 102. The bottom recessed plate 104 returns to its original position immediately, but capillary tension has been established within the sample 102 and fluid will continue to wick radially. To prevent forces other than the absorbent forces from influencing the test, the sample level is automatically adjusted. Non-contact between the sample 102 and any solid surface prevents over-saturation, excess fluid flow, and surface wicking; thereby eliminating artificial effects. Data are recorded, at a data collection speed of five readings per second, as grams of fluid flow from the reservoir to the sample with respect to time. From this data, the speed of intake and the amount of water absorbed by the sample at any given time are determined.

As used herein, holding capacity is measured according to the following test. The same instrument used for the absorbency measurements was used to determine a z-directional (i.e., the sample thickness direction) using the Flat/Flat configuration as shown schematically in FIG. 4.

The sample 108 comprises a stack of five sheets of a 2.5-cm radius circular specimen die-cut. Five sheets (2-⅜" in diameter) of the tissue product are held between the top flat plate 110 and the bottom flat plate 112. The sample 108 is initially lowered 10 mm at 20 mm per second and then raised to maintain 3 mm difference in the level of the sample 108 above the fluid reservoir. This is done to subject the sample 108 to capillary tension of 3 mm of fluid head during the test. As the sample 108 absorbs water from the reservoir, the sample 108 is lowered slightly to maintain the 3 mm capillary tension. The fluid is delivered at the center of the stack 114 for absorption. Data is collected at a rate of 5 points per second. The test is stopped when a Δg/g limit of 0.0300 moving between 50 point and average (0.003 g/g/10 seconds) is reached, giving the holding capacity of the sample.

As used herein, dry bulk and wet bulk are measured according to the following test. The thickness of each sample was measured using a thickness gauge during the holding capacity measurements. To determine the thickness of the sample under various loading conditions, external weight 116 was placed on the top flat plate 110 as shown in FIG. 4.

Dry bulk is determined using the following equation:

$$\text{Dry bulk } (cm^3/gm) = \frac{\text{Dry thickness (mm)}}{\text{Dry Basis Weight } (gm/m^2)} * 10^3$$

Wet bulk is determined using the following equation:

$$\text{Wet bulk } (cm^3/gm) = \frac{\text{Wet thickness (mm)}}{\text{Dry Basis Weight } (gm/m^2)} * 10^3$$

Roll Bulk is the volume of paper divided by its mass on the wound roll. Roll Bulk is calculated by multiplying pi (3.142) by the quantity obtained by calculating the difference of the roll diameter squared in cm squared ($cm^2$) and the outer core diameter squared in cm squared ($cm^2$) divided by 4 divided by the quantity sheet length in cm multiplied by the sheet count multiplied by the bone dry Basis Weight of the sheet in grams (g) per cm squared ($cm^2$).

Roll Bulk in cc/g=3.142×(Roll Diameter squared in $cm^2$−outer Core Diameter squared in $cm^2$)/(4×Sheet length in cm×sheet count×Basis Weight in g/$cm^2$) or Roll Bulk in cc/g=0.785×(Roll Diameter squared in $cm^2$−outer Core Diameter squared in $cm^2$)/(Sheet length in cm×sheet count× Basis Weight in g/$cm^2$).

For various rolled products of this invention, the bulk of the sheet on the roll can be about 11.5 cubic centimeters per gram or greater, preferably about 12 cubic centimeters per gram or greater, more preferably about 13 cubic centimeters per gram or greater, and even more preferably about 14 cubic centimeters per gram or greater.

Geometric mean tensile strength (GMT) is the square root of the product of the machine direction tensile strength and the cross-machine direction tensile strength of the web. As used herein, tensile strength refers to mean tensile strength as would be apparent to one skilled on the art. Geometric tensile strengths are measured using a MTS Synergy tensile tester using a 3 inches sample width, a jaw span of 2 inches, and a crosshead speed of 10 inches per minute after maintaining the sample under TAPPI conditions for 4 hours before testing. A 50 Newton maximum load cell is utilized in the tensile test instrument.

Papermaking fibers, as used herein, include all known cellulosic fibers or fiber mixes comprising cellulosic fibers. Fibers suitable for making the webs of this invention comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988, to Laamanen et al.; U.S. Pat. No. 4,594,130, issued Jun. 10, 1986, to Chang et al.; and U.S. Pat. No. 3,585,104. Useful fibers can also be produced by anthraquinone pulping, exemplified by U.S. Pat. No. 5,595,628, issued Jan. 21, 1997, to Gordon et al. A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present invention include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

SUMMARY OF THE INVENTION

In general, the present disclosure is directed to multi-ply tissue products having improved properties. For example, multi-ply tissue products made according to the present invention have been shown to have enhanced interply absorbency properties. In particular, the different plies included in the tissue product are combined and attached together in a manner that creates a significant amount of void space in between the plies that enhances the ability of the tissue product to absorb and retain liquids, such as water. For example, the present inventors have found that multi-ply products made according to the present invention may hold and retain substantially greater amounts of water than the sum of the liquid holding capacity of the individual plies.

In addition to having enhanced interply absorbency, tissue products made according to the present invention also have great softness properties and bulk properties when either wet or dry.

In one embodiment, for instance, the present invention is directed to the construction of a multi-ply tissue product. Each ply of the tissue product contains papermaking fibers and has a 3-dimensional topography. For instance, each ply may include raised areas and depressed areas. As used herein, the "depressed areas" refer to any depressions appearing on the exterior surface of the tissue product that extend inwardly towards the middle of the product. By including raised areas and depressed areas, a tissue structure is formed having maximum void space. In addition to raised areas and depressed areas, each ply can further have a relatively low basis weight and can be made in order to maintain the maximum void structure by not compressing the web during converting. Thus, in one embodiment, the web does not undergo any significant calendering operations. Each ply can also be made so as to be relatively non-compressive. The web may be made non-compressive by drying the web using a through-air dryer to complete dryness, such that the web contains less than about 2% moisture. In addition, strength agents and/or wet resilient fibers may be added to make the web non-compressive. Through the above combination of elements, a multi-ply product can be formed having enhanced interply absorbency.

In one embodiment of the present invention, the tissue plies may be combined together such that the depressed areas of the first ply contact the depressed areas of the second ply. By having the depressed areas of the first ply contact the depressed areas of the second ply, the ability of the two plies to nest together is minimized, even if the product is spirally wound into a roll.

In one particular embodiment, each of the tissue plies comprise uncreped through-air dried webs in which the depressed areas and the raised areas are molded into the web during the process of making the web. For example, in one embodiment, the raised areas and the depressed areas form ridges and valleys respectively that generally extend in a first direction on the first ply and in a second direction on the second ply. In order to prevent nesting of the plies, the first and second plies may be combined together such that the first direction of the ridges and valleys on the first ply is skewed or otherwise offset to the second direction of the ridges and valleys appearing on the second ply. For example, the first direction may be at an angle of from greater than 0° to 90° with respect to the second direction.

When each of the plies comprise an uncreped through-air dried web, the raised areas and the depressed areas, for instance, may be formed into the web by molding the web against a coarse fabric, such as a fabric having a 3-dimensional topography.

The individual plies of the multi-ply product may be attached together using any suitable technique. For instance, the plies may be mechanically attached together by simply allowing some fiber intermingling to occur between the layers. Alternatively, an adhesive may be applied for attaching the webs together. In one embodiment, for instance, the adhesive may be applied only to the depressed areas in bonding the different plies together.

As stated above, multiple ply tissue products made according to the present invention have been found to possess enhanced water absorbency characteristics. For instance, a multi-ply tissue product made according to the present invention may have an interply absorbency at 30 seconds of greater than about 3 g/g, such as greater than about 4 g/g, such as greater than about 5 g/g, and in one embodiment, even greater than about 6 g/g. The multi-ply tissue product may have a total absorbency of greater than about 10 g/g, such as greater than about 11 g/g, such as greater than about 12 g/g, and, in one embodiment, may even be greater than 12.5 g/g. The initial rate of absorbency of the tissue product may be greater than about 6 g/g after 5 seconds, such as greater than about 7 g/g after 5 seconds, such as greater than about 8 g/g after 5 seconds, or even greater than about 9 g/g after 5 seconds. After 10 seconds, the multi-ply tissue product may have absorbed 8 grams of water per gram fiber, such as greater than 9 grams of water per gram fiber, such as greater than 10 grams of water per gram fiber. For example, in one embodiment, after 10 seconds the multi-ply tissue product may absorb greater than 11 grams of water per gram fiber or even greater than 12 grams of water per gram fiber.

For many multi-ply tissue products, the total absorbency according to the AGAT method described above typically peaks and then begins to decrease over time. Tissue products made according to the present invention, however, have found to retain substantially high amounts of water even after water absorption has peaked. For instance, a multi-ply tissue product made according to the present invention may have a total absorbency after 30 seconds of greater than about 10 g/g, such as greater than 11 g/g, and, in one embodiment, greater than 12 g/g.

Another test of absorbency is liquid holding capacity as described above which tests the absorbency characteristics of five products stacked together. For a multi-ply tissue product made in accordance with the present invention, for instance, the holding capacity may be greater than about 8 g/g, such as greater than 8.5 g/g, such as greater than 9 g/g. In one embodiment, for instance, the holding capacity of the multi-ply tissue product may be even greater than 9.5 g/g.

The principles of the present invention may be used to construct all different types of tissue products, such as facial tissue, paper towels, industrial wipers and the like. In one particular embodiment, the principles of the present invention have been found especially well suited to constructing a two-ply bath tissue. The bath tissue, for instance, may comprise a two-ply product having a basis weight from about 15 gsm to about 30 gsm or from about 30 gsm to about 50 gsm. The tissue product may have a dry bulk of greater than about 15 cc/gm, such as greater than about 16 cc/gm, such as greater than about 17 cc/gm, and, in one embodiment, may be even greater than about 18 cc/gm. The wet bulk of the product may also be relatively high. For instance, a two-ply tissue product may have a wet bulk of greater than about 8.5 cc/gm, such as greater than about 9 cc/gm, and, in one embodiment, may be greater than about 10 cc/gm. The two-ply bath tissue may also have a geometric mean tensile of less than about 1000 g.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the specification, including reference to the accompanying Figures in which.

Figure 1:
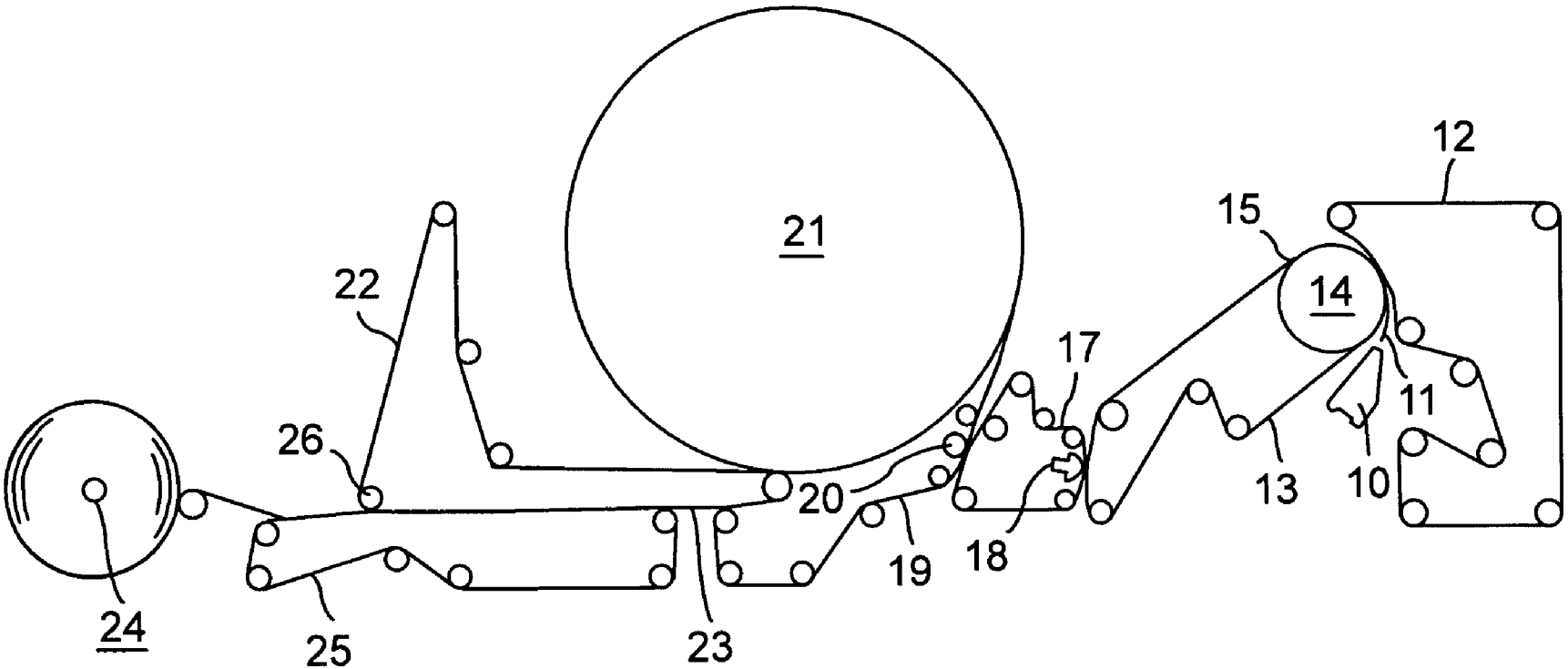
FIG. 1 is a cross-sectional view of one embodiment of a process for making tissue webs for use in the present invention.

Repeated use of reference characters in the present specification and drawings is intended to represent the same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the exemplary construction.

In general, the present disclosure is directed to multiple ply tissue products having relatively high sheet and roll bulk while also having enhanced liquid absorbency, liquid holding capacity, and rate. The principles of the present invention may apply generally to any suitable multi-ply tissue product. The tissue product, for instance, may be a facial tissue, paper towel, industrial wiper, medical drape, napkin, and the like. The tissue product may contain at least two plies, such as three plies or greater. In one particular embodiment, for instance, the tissue product comprises a two-ply bath tissue that is spirally wound into a roll.

In order to construct multi-ply tissue products having enhanced liquid absorbency in accordance with the present invention, a combination of various factors and techniques may be used in constructing the multi-ply product. In particular, the multi-ply tissue products made according to the present invention contain tissue plies made with a structure that maximizes void space which allows the product to absorb greater amounts of liquids. For example, in one embodiment, each ply contained with the multi-ply product is constructed so as to have at least one high topography surface. For example, each ply may contain raised areas and depressed areas. The plies are also formed so as to maintain the high void structure during converting into a final product. For instance, in one embodiment, the plies are not subjected to any substantial compressive forces during converting. For example, the plies are not calendered or minimally calendered during production of the final product.

Each ply may also be relatively non-compressive. For instance, each ply may be dried with a through-air dryer to complete dryness. The plies may be dried with a through-air dryer so that they contain less than about 2% moisture. This type of drying process makes the webs non-compressive and makes the three-dimensional structure of the web resilient. In order to make the webs non-compressive, a strength agent may also be added to the tissue plies.

In addition to the above combination of factors, in one embodiment, each tissue ply may have a relatively low basis weight, which, in some embodiments, has also been found to enhance absorbency properties. The basis weight of each ply, for instance, may be less than about 25 gsm, such as less than 20 gsm, or less than about 15 gsm.

In addition to the above, the plies may also be combined together in a manner that maximizes void space contained between the plies. For instance, the plies may be combined together such that the depressed areas contact each other which has been found to create a significant amount of void space in between the plies. Combining the plies as described above has also been found to prevent the structure of the product from collapsing even when compressed or wet. Thus, the products have been found to have a relatively high bulk even when the tissue product is spirally wound into a roll.

Of particular advantage, the present inventors have also discovered that by combining the plies as described above, the void space between the plies leads not only to a higher absorbency but also to a faster liquid absorption rate. Specifically, it has been discovered that the total liquid absorbency of the multi-ply product is significantly greater than the sum of the liquid absorbency of each of the individual plies. Specifically, the multi-ply products have been found to have an enhanced interply liquid absorbency which refers to the amount of fluid that can be held in between the plies.

Base webs that may be used in the process of making multi-ply products in accordance with the present invention can vary depending upon the particular application. In general, any suitably made base web may be used in the process of the present invention. Further, the webs can be made from any suitable type of fiber. For instance, the base web can be made from pulp fibers, other natural fibers, synthetic fibers, and the like.

Papermaking fibers useful for purposes of this invention include any cellulosic fibers which are known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, secondary fibers means any cellulosic fiber which has previously been isolated from its original matrix via physical, chemical or mechanical means and, further, has been formed into a fiber web, dried to a moisture content of about 10 weight percent or less and subsequently reisolated from its web matrix by some physical, chemical or mechanical means.

Tissue webs made in accordance with the present invention can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with desired characteristics. For example, layers containing softwood fibers have higher tensile strengths than layers containing hardwood fibers. Hardwood fibers, on the other hand, can increase the softness of the web. In one embodiment, a base web includes at least one outer layer containing primarily hardwood fibers. The hardwood fibers can be mixed, if desired, with paper broke in an amount up to about 10% by weight and/or softwood fibers in an amount up to about 10% by weight. The base web further includes a second layer positioned adjacent the outer layer. The second layer can contain primarily softwood fibers. If desired, other fibers, such as high-yield fibers or synthetic fibers may be mixed with the softwood fibers in an amount up to about 10% by weight.

When constructing a web from a stratified fiber furnish, the relative weight of each layer can vary depending upon the particular application. For example, in one embodiment, when constructing a web containing two layers, each layer can be from about 15% to about 60% of the total weight of the web.

As described above, the tissue plies can generally be formed by any of a variety of papermaking processes known in the art. In fact, any process capable of forming a tissue web can be utilized in the present invention. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. No. 5,048,589 to Cook. et al.; U.S. Pat. No. 5,399,412 to Sudall et al.; U.S. Pat. No. 5,129,988 to Farrinqton, Jr.; and U.S. Pat. No. 5,494,554 to Edwards et al.; which are incorporated herein in their entirety by reference thereto for all purposes. When forming the multi-ply tissue products, the separate plies can be made from the same process or from different processes as desired.

For example, the web can contain pulp fibers and can be formed in a wet-lay process according to conventional paper making techniques. In a wet-lay process, the fiber furnish is combined with water to form an aqueous suspension. The aqueous suspension is spread onto a wire or felt and dried to form the web.

In one embodiment, the base web is formed by an uncreped through-air drying process. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Specifically, the suspension of fibers is deposited on the forming fabric 13 between a forming roll 14 and another dewatering fabric 12. Additional dewatering of the wet web can be carried out, such as by vacuum suction, while the wet web is supported by the forming fabric.

The wet web is then transferred from the forming fabric to a transfer fabric 17 that may be traveling at a slower speed than the forming fabric in order to impart increased stretch into the web. Transfer is preferably carried out with the assistance of a vacuum shoe 18 and a kiss transfer to avoid compression of the wet web.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance. In one embodiment, for instance, the tissue web may be molded against the throughdrying fabric in order to form raised areas and depressed areas in the web.

The level of vacuum used for the web transfers can be, for instance, from about 3 to about 15 inches of mercury (75 to about 380 millimeters of mercury), such as about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

The amount of vacuum applied to the web during transfers should be in an amount so as to minimize or completely avoid the formation of pinholes in the sheet. Specifically, the vacuum levels can be maintained at a sufficiently low level so as to not pull excessive pinholes into the paper web. While attempting to produce high-bulk tissue, higher vacuum levels are typically preferred. The vacuum levels, however, should be adjusted in order to avoid the formation of pinholes while still maximizing bulk. In this regard, tissue webs made according to the present invention can be formed without the formation of pinholes.

While supported by the throughdrying fabric, the web is dried to a consistency of about 94 percent or greater, such as greater than about 97 percent, by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di (hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

In manufacturing the tissues of this invention, it is preferable to include a transfer fabric to improve the smoothness of the sheet and/or impart sufficient stretch. As used herein, "transfer fabric" is a fabric which is positioned between the forming section and the drying section of the web manufacturing process. The fabric can have a relatively smooth surface contour to impart smoothness to the web, yet must have enough texture to grab the web and maintain contact during a rush transfer. It is preferred that the transfer of the web from the forming fabric to the transfer fabric be carried out with a "fixed-gap" transfer or a "kiss" transfer in which the web is not substantially compressed between the two fabrics in order to preserve the caliper or bulk of the tissue and/or minimize fabric wear.

In order to provide stretch to the tissue, a speed differential may be provided between fabrics at one or more points of transfer of the wet web. This process is known as rush transfer. The speed difference between the forming fabric and the transfer fabric can be from about 5 to about 75 percent or greater, such as from about 10 to about 35 percent. For instance, in one embodiment, the speed difference can be from about 15 to about 25 percent, based on the speed of the slower transfer fabric. The optimum speed differential will depend on a variety of factors, including the particular type of product being made. As previously mentioned, the increase in stretch imparted to the web is proportional to the speed differential. The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and stretch. It is therefore useful to have moderately coarse and moderately three-dimensional transfer fabrics and throughdrying fabrics which are quite coarse and three dimensional in the optimized configuration. The result is that a relatively smooth sheet leaves the transfer section and then is macroscopically rearranged (with vacuum assist) to give the high bulk, high stretch surface topology of the throughdrying fabric. Sheet topology is completely changed from transfer to throughdrying fabric and fibers are macroscopically rearranged, including significant fiber-fiber movement.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. Suitable throughdrying fabrics include, without limitation, Asten 920A and 937A and Velostar P800 and 103A. Additional suitable throughdrying fabrics include fabrics having a sculpture layer and a load-bearing layer such as those disclosed in U.S. Pat. No. 5,429,686, incorporated herein by reference to the extent it is not contradictory herewith. The web is preferably dried to final dryness on the throughdrying fabric, without being pressed against the surface of a Yankee dryer, and without subsequent creping.

During the through-air drying process, the side of the tissue web 23 that contacts the drier fabric is generally referred to as the fabric side of the web. In some applications, the fabric side may be softer than the opposite side. The opposite side of the web, which is not in contact with the drier fabric, is typically referred as the air side. When the tissue web 23 is combined with a second web for forming a tissue product in accordance with the present invention, either the fabric side of the web or the air side of the web may form an exterior surface of the product. As stated above, due to the molding of the tissue web on the drier fabric, raised areas and depressed areas may be formed into the tissue web. The shape of the raised areas and the depressed areas thus generally depends upon the topography of the drying fabric. In general, the raised areas and the depressed areas may have any suitable geometric shape for purposes of the present invention.

Figure 2C:
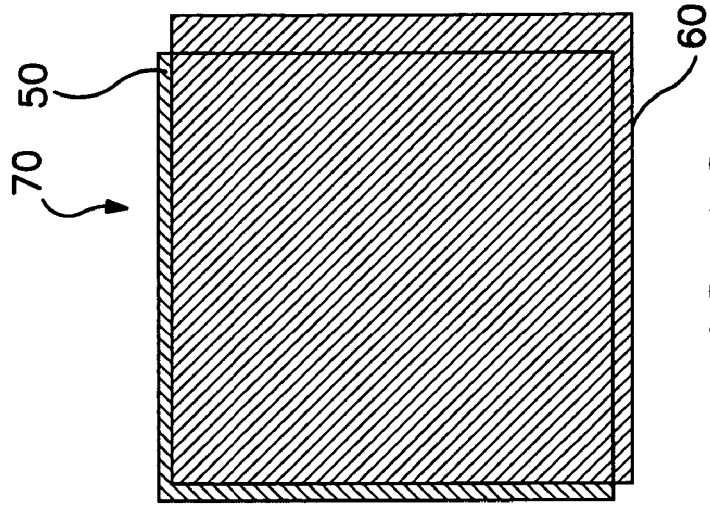
FIGS. 2A, 2B and 2C represent the construction of one embodiment of a tissue product made in accordance with the present invention.
Figure 2B:
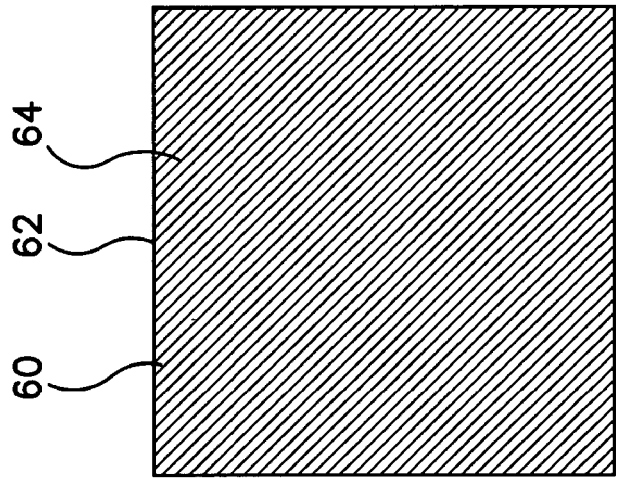
Figure 2A:
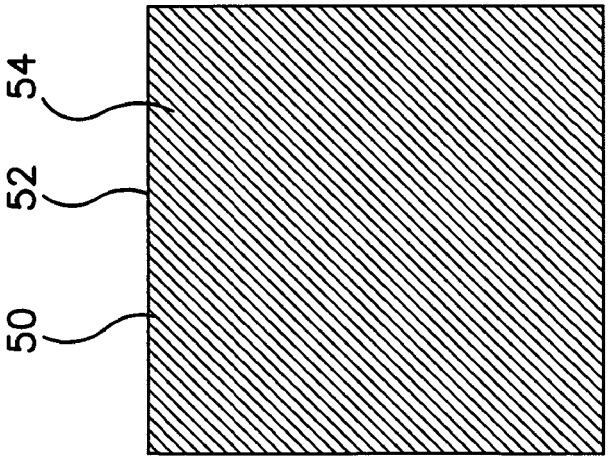

In one particular embodiment, however, as shown in FIGS. 2A and 2B, the raised areas and the depressed areas formed into the through-air dried web may be in the form of ridges and valleys that generally extend in a certain direction. For example, referring to FIG. 2A, a through-air dried tissue web 50 is illustrated that includes a plurality of ridges 52 separated by a plurality of valleys 54. As shown, the ridges 52 and the valleys 54 generally extend parallel to one another in a diagonal direction in this embodiment.

Referring to FIG. 2B, a through-air dried tissue web 60 is similarly shown. The tissue web 60 includes raised areas or ridges 62 separated by depressed areas or valleys 64. Once again, the ridges 62 and the valleys 64 generally extend in a certain direction.

In accordance with the present invention, the first web or ply 50 is combined with the second web or ply 60 to form a two-ply tissue product 70 as illustrated in FIG. 2C. As shown in FIG. 2C, the tissue plies 50 and 60 are combined together such that the ridges and valleys of each ply are in an offset relationship. In other words, the direction of the ridges 52 and valleys 54 of the tissue ply 50 are at an angle or are skewed to the ridges 62 and the valleys 64 of the tissue web 60. In this manner, when the two webs are brought together, only the depressed areas or the valleys contact each other. Since the valleys contact each other, the webs 50 and 60 are prevented from nesting together. If the two-ply tissue product 70 is wound into a roll, the construction also prevents adjacent sheets from nesting together as well.

As shown in FIGS. 2A through 2C, the through-air dried webs are created with generally parallel ridges and valleys. When forming a through-air dried web, these ridges and valleys are formed into the web by molding the web against a fabric, which may be the throughdrying fabric. The ridges and valleys are formed into the web due to ridges and valleys present in the drying fabric. In order to combine the webs so that the ridges and valleys are in an offset relationship as shown in FIG. 2C, different drying fabrics may be used to form the two different webs. For example, one drying fabric may be used to form ridges and valleys in the machine direction. A second web is then formed on a different drying fabric in which the ridges and valleys are in the cross machine direction or are in a diagonal relationship to the machine direction.

The amount the ridges and valleys of one web are offset in relation to the ridges and valleys of another web can vary depending upon the particular application. In general, however, any minimal angle of difference should prevent the webs from nesting in most applications. Thus, the parallel ridges and valleys of one web may be offset from the parallel ridges and valleys of another web by greater than 0° to about 90°, such as from about 10° to about 80°.

It should be understood that the tissue product 70 as shown in FIG. 2C represents merely one embodiment of a tissue product made in accordance with the present invention. As stated above, the raised areas and depressed areas may have any suitable shape. Parallel ridges and valleys as shown in the figures may be substituted, for instance, for any suitable discrete geometric shape or pattern. Further, it should be understood that the raised areas and depressed areas may be formed into the tissue web using any other suitable papermaking technique instead of or in addition to molding the structure into the webs using a through-air dryer.

It should be also understood that placing the depressed areas in the plies in an offset relationship may not be necessary in all applications in order to produce multi-ply products that have enhanced interply absorbency properties in accordance with the present invention.

In one embodiment, especially when the tissue product contains through-air dried webs, the web can be made with little to no compression such as described with respect to the process illustrated in FIG. 1. Specifically, in order to preserve the shape of the raised areas and depressed areas, in certain embodiments, the tissue plies are not calendered or subjected to any other types of compressive forces.

The plies of the multi-ply tissue product such as the tissue product 70 shown in FIG. 2C may be attached or connected together using any suitable technique or means. For example, in one embodiment, the webs may be mechanically attached together. In this embodiment, for instance, fiber entanglement from one ply to the next is sufficient in forming the product. Fiber crimping techniques can also be used to create a mechanical interlocking bond.

In an alternative embodiment, an adhesive material may be used to attach the two plies together. In one embodiment, for instance, an adhesive material may only be applied to the tops of the depressed areas on the tissue plies for only attaching the depressed areas together. In still another embodiment, the depressed areas of both tissue plies may be each coated with one part of a two-part adhesive such that ply bonding takes place only where the depressed areas align when the sheets are mated and attached. The adhesive application may be uniform across the entire surface area of the sheet or may be applied in selected areas.

As described above, the manner in which the multiple ply tissue products of the present invention are formed has found to lead to greater total liquid absorbency, a faster liquid absorption rate, and/or a higher interply liquid asorbency. For instance, tissue products made according to the present invention may have a total liquid absorbency (according to the AGAT test described above) of greater than about 10 g/g, such as greater than about 11 g/g, such as greater than about 12 g/g. For example, in one embodiment, a two-ply tissue product may be constructed that has a total absorbency of greater than about 12.5 g/g. After tissue products reach a maximum total absorbency, many products have a tendency to collapse and release liquids. Of particular advantage, however, multiple ply tissue products made according to the present invention have found to have a structure that is resilient even when wet. In this regard, the tissue products may have a total absorbency after 30 seconds of greater than about 10 g/g, such as greater than 11 g/g, and, in one embodiment, may have an absorbency of greater than about 12 g/g. Thus, the tissue products have been found to retain their liquid absorption abilities even after reaching a maximum.

Tissue products made according to the present invention also have a rapid initial rate of absorbency. For instance, the tissue products may have an absorbency of greater than about 6 g/g after 5 seconds, such as greater than about 7 g/g after 5 seconds, such as greater than about 8 g/g after 5 seconds, or even greater than about 9 g/g after 5 seconds. After 10 seconds, the tissue product may have an absorbency of greater than about 8 g/g, such as greater than about 9 g/g, such as greater than about 10 g/g, such as greater than about 11 g/g, or even greater than about 12 g/g.

Of particular advantage, tissue products made according to the present invention contain a substantial amount of void space in between the adjacent plies which greatly enhances the ability of the product to absorb liquids. The measure of this enhanced liquid absorbency is referred to herein as interply absorbency which refers to the total amount of fluid that can be held between the plies. The interply absorbency is measured by subtracting from total absorption of the tissue product the summation of the absorption of the individual plies. Tissue products made according to the present invention, for example, have been found to have an interply absorbency of greater than about 3 g/g after 30 seconds, such as greater than 4 g/g after 30 seconds, such as greater than 5 g/g after 30 seconds, and even greater than 6 g/g after 30 seconds.

Finally, the tissue products have also been found to be capable of retaining fluids even under a load indicating that the products have relatively high wicking properties in the Z-direction. For instance, tissue products made according to the present invention may have a liquid holding capacity of greater than about 8 g/g, such as greater than about 8.5 g/g, such as greater than 9 g/g, or even greater than about 9.5 g/g.

In addition to the liquid absorption properties as described above, tissue products made according to the present invention also have a relatively high bulk. For example, the tissue products may have a dry bulk of greater than about 15 cc/gm, such as greater than about 16 cc/gm, such as greater than about 17 cc/gm, or, even greater than about 18 cc/gm. The products may have a wet bulk of greater than about 8.5 cc/gm, such as greater than about 9 cc/gm, and, in one embodiment, may have a wet bulk greater than about 10 cc/gm. In addition to relatively high sheet bulk properties, tissue products made according to the present invention also can have relatively high roll bulk properties when the tissue sheet is wound into a roll. For instance, the roll bulk of multi-ply tissue products made in accordance with the present invention may be greater than about 8 cc/gm, such as greater than about 9 cc/gm.

The geometric mean tensile strength of tissue products formed according to the present invention can be greater than about 600 g per 3 inches, particularly greater than about 650 g per 3 inches, and more particularly greater than about 700 g per 3 inches.

The geometric mean tensile strength will vary depending upon the basis weight of the plies, the manner in which the plies are produced, and the fiber furnish used to form the web. When producing bath tissue, for instance, the geometric mean tensile strength may be less than about 1000 g per 3 inches.

The total basis weight of the multi-ply tissue products made in accordance with the present invention may generally be greater than about 20 gsm bone dry. For instance, in various embodiments, the basis weight may vary from about 20 gsm to about 120 gsm. The basis weight of any particular product would generally depend upon the final use of the product. For example, a multi-ply bath tissue may generally have a basis weight from about 20 gsm to about 50 gsm, such as from about 20 gsm to about 45 gsm, and, in one embodiment, from about 25 gsm to about 35 gsm. Other tissue products, however, such as paper towels and the like may have a basis weight of from about 40 gsm to about 120 gsm, such as from about 50 gsm to about 80 gsm.

The following examples are intended to illustrate particular embodiments of the present invention without limiting the scope of the appended claims.

EXAMPLES

Example 1

Interply Absorbency

SCOTTEX (Kimberly-Clark Corp.), COTTONELLE ULTRA (Kimberly-Clark Corp.), CHARMIN ULTRA (Procter and Gamble), NORTHERN ULTRA (Georgia Pacific) and 10 samples produced according to the present invention and described below were tested for their 1-ply total absorbency, 2-ply total absorbency, and interply absorbency.

Sample 1 was produced with a pilot tissue machine per U.S. Pat. No. 5,656,132. A three-layer tissue web was produced. The softwood fibers and hardwood fibers were pulped separately for 30 minutes with steam and diluted to about 3 percent consistency after pulping. Parez 631-NC, available from American Cyanamid Co, was added to the center layer only at 1.5 Kg/Tonne (based on that layer only) to provide temporary wet strength. ProSoft TQ-1003, available from Hercules, Inc., was added to the outer layers at 1.0 Kg/Tonne (also based on the layers) as a softening agent. 100% softwood fiber was added to the center layers and 75% eucalyptus/25% broke was added to each of the outer layers. The softwood fibers were mechanically treated with "no load" refining (less than 0.5 HPD/ton). The overall layered sheet weight was split 34% to the center layer on a dry fiber basis and 33% to each of the outer layers making the overall split of approximately 38% softwood fibers/62% hardwood fibers.

A three-layered headbox include turbulence-generating inserts recessed about 3.5 inches (89 millimeters) from the slice and layer dividers extending about 1 inch (25 millimeters) beyond the slice were employed. The consistency of the stock fed to the headbox was about 0.1 weight percent.

The resulting three-layered sheet was formed on a twin-wire, suction form roll, former, with the outer forming fabric and the inner forming fabric being obtained from Voith Fabrics Enterprise. The newly-formed web was then dewatered to a consistency of about 27-29 percent using vacuum suction from below the forming fabric before being transferred to the transfer fabric, which was traveling slower than the forming fabric (28 percent rush transfer). The transfer fabric was a relatively flat low topography, 70 mesh fabric. A vacuum shoe pulling about 10 inches of mercury rush transfer vacuum was used to transfer the web to the transfer fabric.

The web was then transferred to a coarse topographical, 30 mesh, diagonal patterned through-drying fabric. A vacuum transfer roll was used to wet mold the sheet into the through-drying fabric at about 11.0 inches of mercury wet molding vacuum. The web was carried over a pair of Honeycomb through-dryers fabric operating at a temperature of about 385° F. and dried to final dryness of about 98 percent consistency. An s-wrap configuration was engaged (61 deg., 90 Hyuck) to reduce caliper and allow more yardage on the parent roll.

The basesheet was subsequently converted into two-ply finished product. Each parent roll was loaded onto one of two unwinds so that the fabric sides were outward and sent through through the first calender stack consisting of a 5 P&J rubber roll on top and steel roll on the bottom. The engagement was set to a nip width of 3 mm. Upon exiting the first calender stack, the two basesheets were ply bonded together using a Nordson Hot Melt Application System (Model No. DX 902 Melter) at an approx. add-on rate of 7.0 mg/lineal meter. The two webs were separated and hot-melt glue applied to the bottom web. Following glue application, the plies were converged through a second calender stack consisting of 83 shore A rubber roll on top and steel on the bottom using a 4 mm nip width. The two-ply sheet was wound up into finished product roll of bath tissue with a finished basis weight of approx. 26 grams per square meter (gsm) per ply.

Samples 2-6 were handmade in an effort to achieve maximum interply absorbency. The samples were created using the basesheet made according to the process described above. The basesheet was taken directly from the parent roll prior to converting and cut to approximately one square foot samples using a paper cutter. Then the basesheet was made into samples by placing two or more sheets together.

Sample 2 had two sheets that were placed together with the fabric sides out and the ripples formed in the sheet by the through-air dryer in the same direction.

Sample 3 had two sheets that were placed together with the fabric sides out and a 90 degree offset (i.e. ripples of one sheet at a 90 degree offset to the ripples of the other sheet.)

Sample 4 was a 3-ply tissue. The first two sheets were placed together with the fabric sides out and the ripples in the same direction. A third sheet was placed on top of the other two with the air side out (fabric side facing the other two sheets).

Sample 5 was a 3-ply tissue. The first two sheets were placed together with the fabric sides out and a 90 degree offset. A third sheet was placed on top of the other two with the air side out (fabric side facing the other two sheets) and a 90 degree offset.

Sample 6 had two sheets that were placed together with the air sides out (fabric sides in) and with the ripples extending in the same direction.

For Samples 7-10, the basesheet was made the same as in Example 1 except that refining was increased to 4.0 HPD/Tonne in the center layer and basis weight per ply was approx. 13 gsm. The S-wrap configuration was not engaged. Also, the converting process was changed for each sample.

For Sample 7, the basesheet was made the same as in Example 1 except for each parent roll was loaded onto one of two unwinds with the fabric sides oriented outward. The two-ply sheet was wound up into finished product rolls of bath tissue in the absence of calendering.

For Sample 8, the basesheet was made the same as in Example 1 except for each parent roll was loaded onto one of two unwinds with the fabric sides oriented outward. The two-ply sheet was crimped in the absence of calendering prior to being wound into finished product rolls of bath tissue.

For Sample 9, the basesheet was made the same as in Example 1 except each parent roll was loaded onto one of two unwinds with the air sides oriented outward. The two-ply sheet was wound up into finished product rolls of bath tissue in the absence of calendering.

For Sample 10, the basesheet was made same as in Example 1 except for each parent roll was loaded onto one of two unwinds with the air sides oriented outward. The two-ply sheet was crimped in the absence of calendering prior to being wound into finished product rolls of bath tissue.

Figure 3:
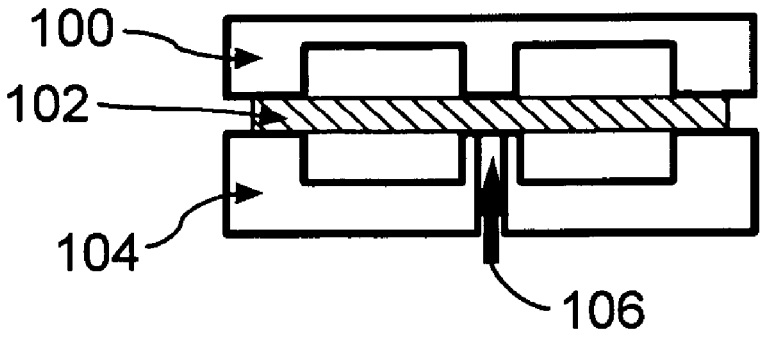
FIG. 3 is a cross sectional view of an apparatus used to conduct absorbency tests.

Each Sample was then die cut to the appropriate dimensions per the AGAT protocol and tested for 1-ply, 2-ply, and interply absorbency using the AGAT test method described above and illustrated in FIG. 3.

Each test was run five times, the averages of which are reported below:

| | 1-Ply Absorbency (g/g) | | | | | |
|---|---|---|---|---|---|---|
| Sample | 5 sec | 10 sec | 15 sec | 20 sec | 25 sec | 30 sec |
| Scottex | 3.169 | 4.210 | 5.073 | 5.693 | 6.075 | 6.446 |
| Cottonelle | 1.787 | 2.474 | 3.137 | 3.692 | 4.147 | 4.596 |
| Charmin | 1.955 | 2.594 | 3.157 | 3.675 | 4.147 | 4.581 |
| Northern | 1.314 | 1.799 | 2.226 | 2.602 | 2.947 | 3.255 |
| Sample 1 | 2.269 | 2.856 | 3.364 | 3.808 | 4.189 | 4.546 |
| Sample 2 | 3.499 | 4.143 | 4.655 | 5.084 | 5.472 | 5.814 |
| Sample 3 | 3.504 | 4.150 | 4.668 | 5.116 | 5.500 | 5.870 |
| Sample 4 | 3.789 | 4.548 | 5.153 | 5.652 | 6.066 | 6.411 |
| Sample 5 | 3.527 | 4.183 | 4.719 | 5.171 | 5.549 | 5.871 |
| Sample 6 | 3.669 | 4.441 | 5.060 | 5.597 | 6.000 | 6.349 |
| Sample 7 | 3.169 | 3.719 | 4.151 | 4.511 | 4.884 | 5.211 |
| Sample 8 | 2.904 | 3.409 | 3.791 | 4.138 | 4.465 | 4.764 |
| Sample 9 | 3.240 | 3.880 | 4.398 | 4.827 | 5.180 | 5.494 |
| Sample 10 | 2.998 | 3.563 | 4.036 | 4.392 | 4.747 | 5.056 |

| | 2-Ply Absorbency (g/g) | | | | | |
|---|---|---|---|---|---|---|
| Sample | 5 sec | 10 sec | 15 sec | 20 sec | 25 sec | 30 sec |
| Scottex | 5.477 | 7.884 | 8.907 | 9.252 | 9.320 | 9.320 |
| Cottonelle | 2.195 | 3.356 | 4.347 | 5.102 | 5.695 | 6.251 |
| Charmin | 2.215 | 3.220 | 4.087 | 4.826 | 5.503 | 6.097 |
| Northern | 1.874 | 2.792 | 3.543 | 4.223 | 4.815 | 5.332 |
| Sample 1 | 4.067 | 6.126 | 7.406 | 8.397 | 9.086 | 9.404 |
| Sample 2 | 8.299 | 10.496 | 11.167 | 11.257 | 11.277 | 11.294 |
| Sample 3 | 8.663 | 11.270 | 12.215 | 12.357 | 12.389 | 12.403 |
| Sample 4 | 9.221 | 11.620 | 12.023 | 12.053 | 12.060 | 12.067 |
| Sample 5 | 9.082 | 11.954 | 12.735 | 12.847 | 12.854 | 12.854 |
| Sample 6 | 9.239 | 11.858 | 12.367 | 12.407 | 12.418 | 12.422 |
| Sample 7 | 8.086 | 10.541 | 11.236 | 11.328 | 11.339 | 11.354 |
| Sample 8 | 7.502 | 10.215 | 10.949 | 11.043 | 11.070 | 11.086 |
| Sample 9 | 7.499 | 10.440 | 11.709 | 12.018 | 12.103 | 12.115 |
| Sample 10 | 7.455 | 10.228 | 11.407 | 11.658 | 11.714 | 11.722 |

Interply absorbency was calculated by subtracting 1-ply total absorption from the 2-ply total absorption. (Note that the same procedure is used for 3- or greater ply tissue, such as in samples 4 and 5. Since the single-ply value is in g/g, it can be directly subtracted from the multi-ply value to yield the interply absorbency as long as all values are in g/g).

| | Interply Absorbency [2-ply − 1-ply)] (g/g) | | | | | |
|---|---|---|---|---|---|---|
| Sample | 5 sec | 10 sec | 15 sec | 20 sec | 25 sec | 30 sec |
| Scottex | 2.309 | 3.674 | 3.833 | 3.559 | 3.245 | 2.874 |
| Cottonelle | 0.409 | 0.882 | 1.210 | 1.410 | 1.548 | 1.655 |
| Charmin | 0.260 | 0.626 | 0.930 | 1.151 | 1.356 | 1.516 |
| Northern | 0.560 | 0.993 | 1.317 | 1.621 | 1.868 | 2.077 |
| Sample 1 | 1.797 | 3.270 | 4.042 | 4.589 | 4.896 | 4.857 |
| Sample 2 | 4.800 | 6.352 | 6.512 | 6.173 | 5.804 | 5.479 |
| Sample 3 | 5.159 | 7.120 | 7.547 | 7.241 | 6.889 | 6.533 |
| Sample 4 | 5.432 | 7.072 | 6.870 | 6.401 | 5.994 | 5.657 |
| Sample 5 | 5.554 | 7.771 | 8.015 | 7.676 | 7.306 | 6.984 |
| Sample 6 | 5.570 | 7.417 | 7.307 | 6.810 | 6.417 | 6.072 |
| Sample 7 | 4.917 | 6.822 | 7.085 | 6.817 | 6.455 | 6.144 |
| Sample 8 | 4.598 | 6.806 | 7.158 | 6.904 | 6.605 | 6.321 |
| Sample 9 | 4.259 | 6.560 | 7.310 | 7.192 | 6.924 | 6.621 |
| Sample 10 | 4.457 | 6.665 | 7.371 | 7.266 | 6.968 | 6.666 |

The results are also graphically illustrated in FIGS. 5-11. It can be appreciated that the present invention has a substantially superior interply absorbency across all time ranges, while all products tested had very similar absorption rates for the 1-ply tissue.

Example 2

Holding Capacity

SCOTTEX (Kimberly-Clark Corp.), COTTONELLE ULTRA (Kimberly-Clark Corp.), CHARMIN ULTRA (Proctor and Gamble), and Samples 7-10 described above were then tested for their holding capacity of 5 sheets. Holding capacity is reported in grams of water per grams of sample. The load on the samples, due to the weight of the plunger and flat plate was 0.05 psi (pounds per square inch).

Figure 4:
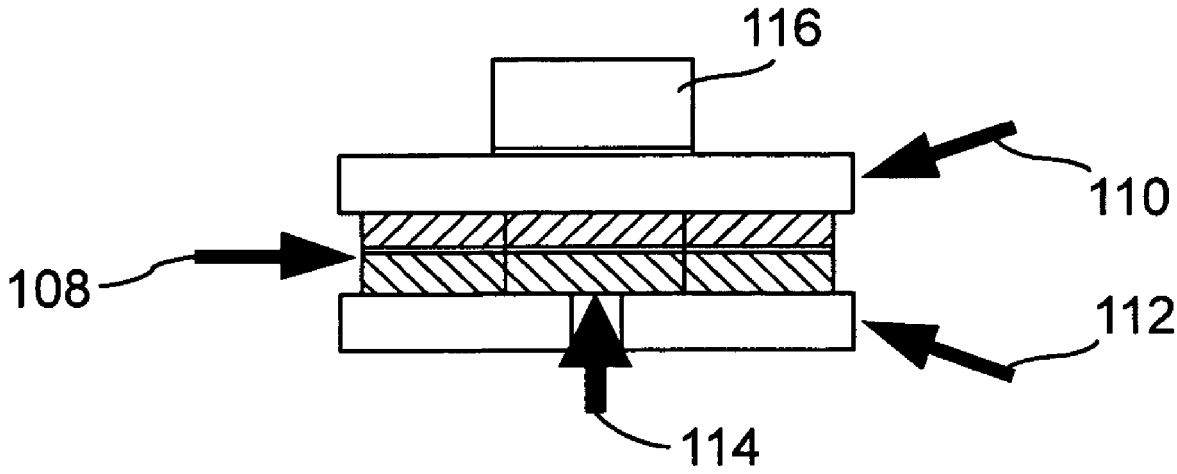
FIG. 4 is a cross sectional view of another apparatus used to conduct absorbency tests.
Figure 5:
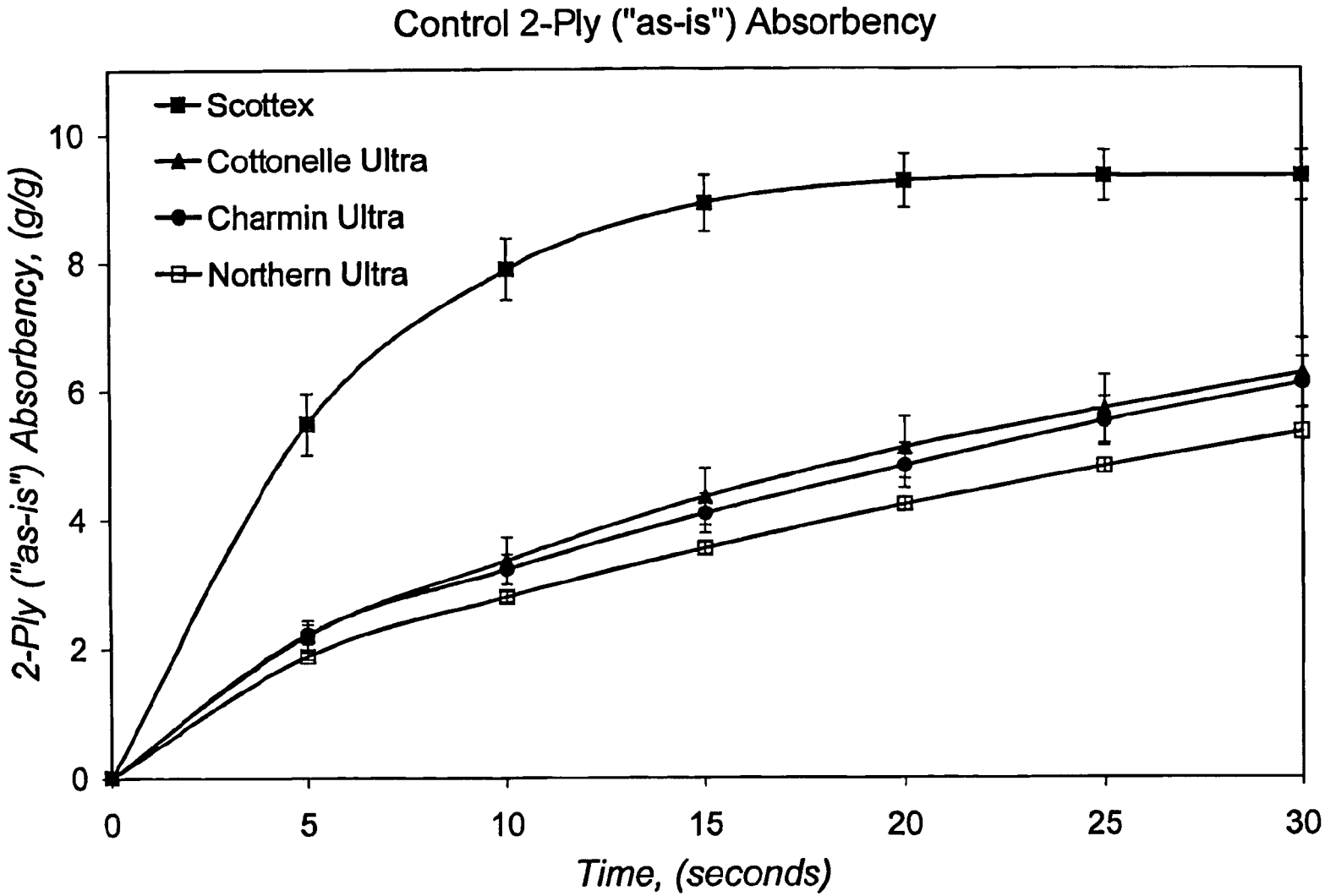
FIGS. 5-17 represent a graphical representation of the results obtained in the examples.
Figure 6:
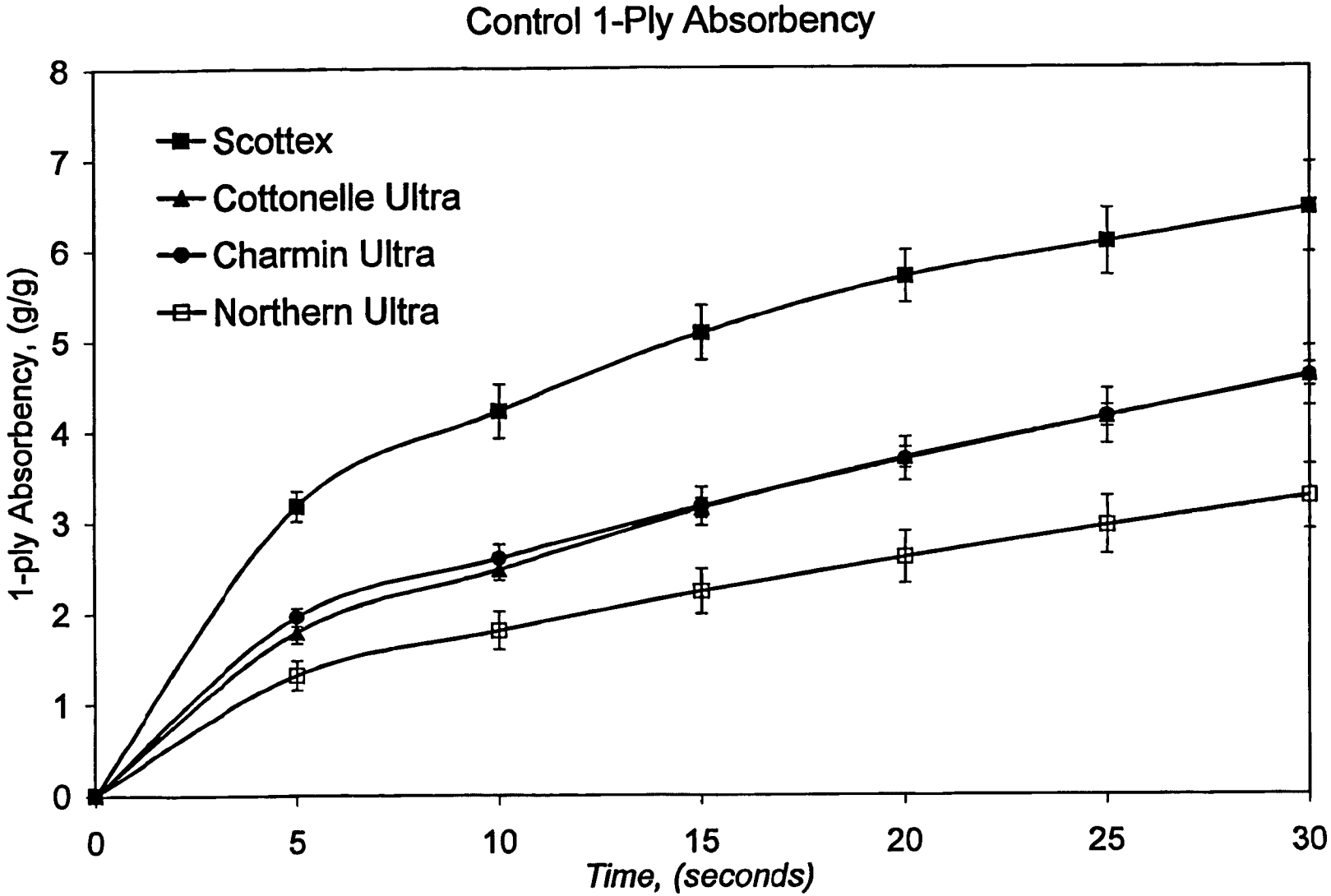
Figure 7:
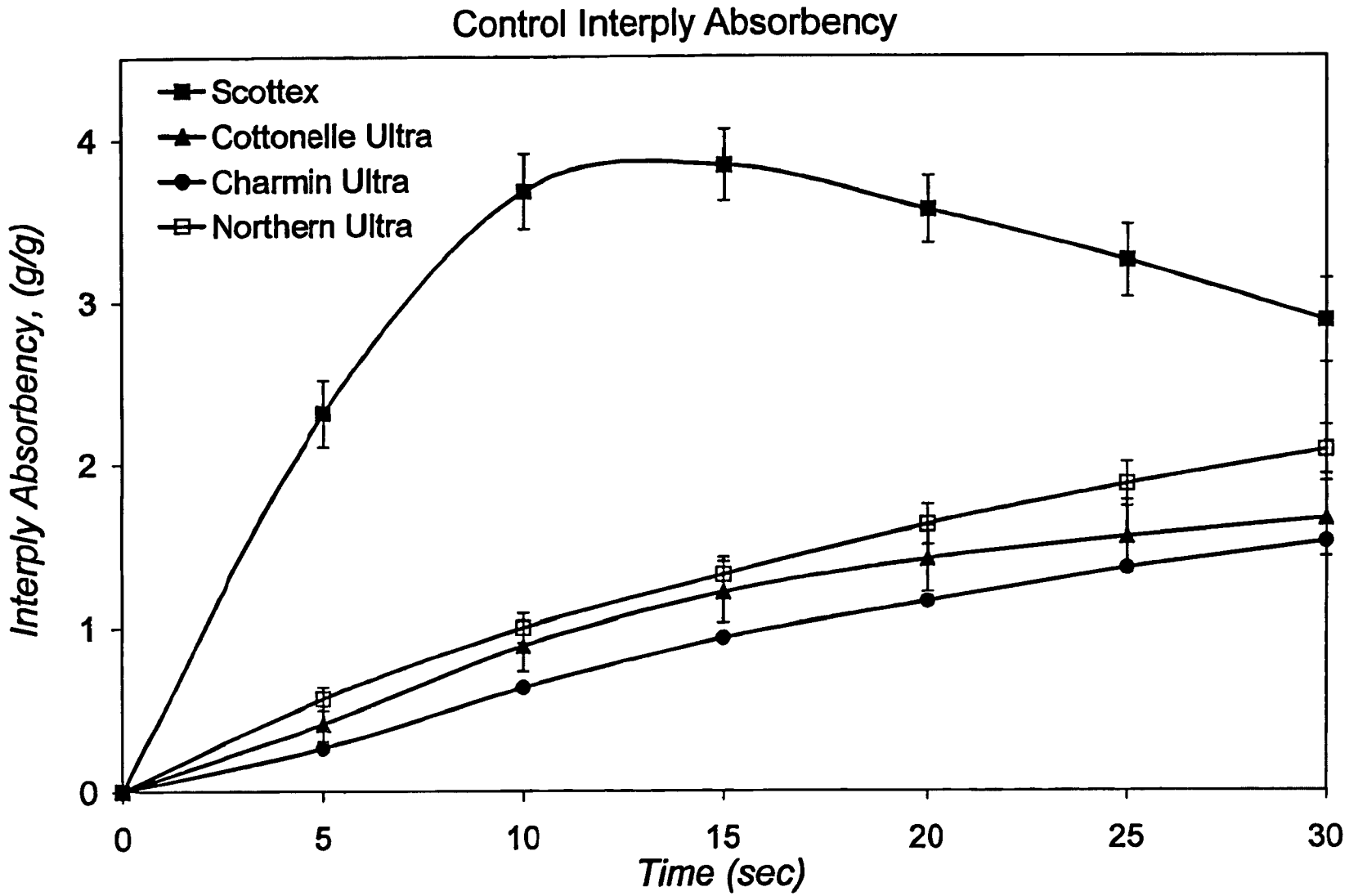
Figure 8:
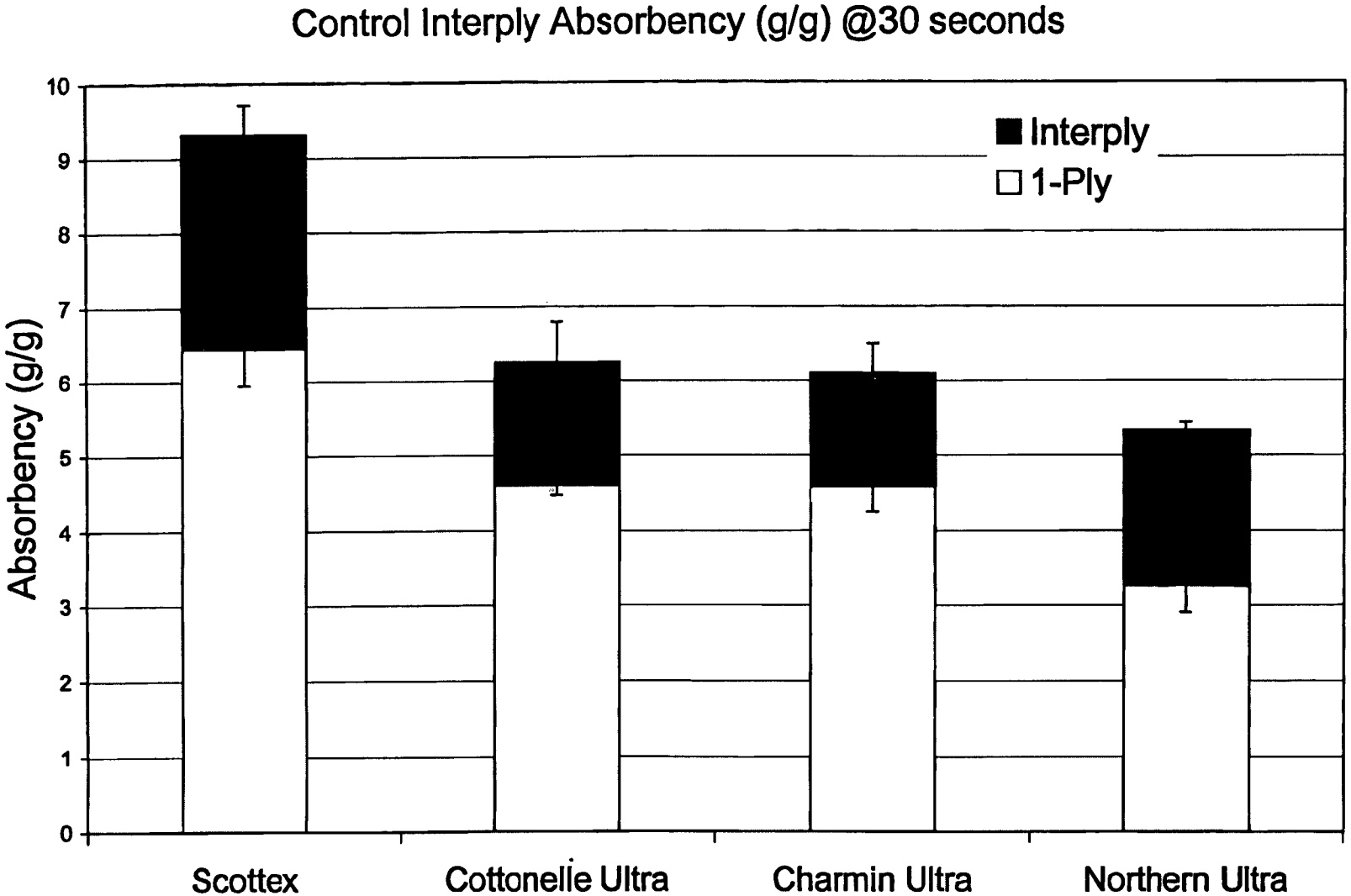
Figure 9:
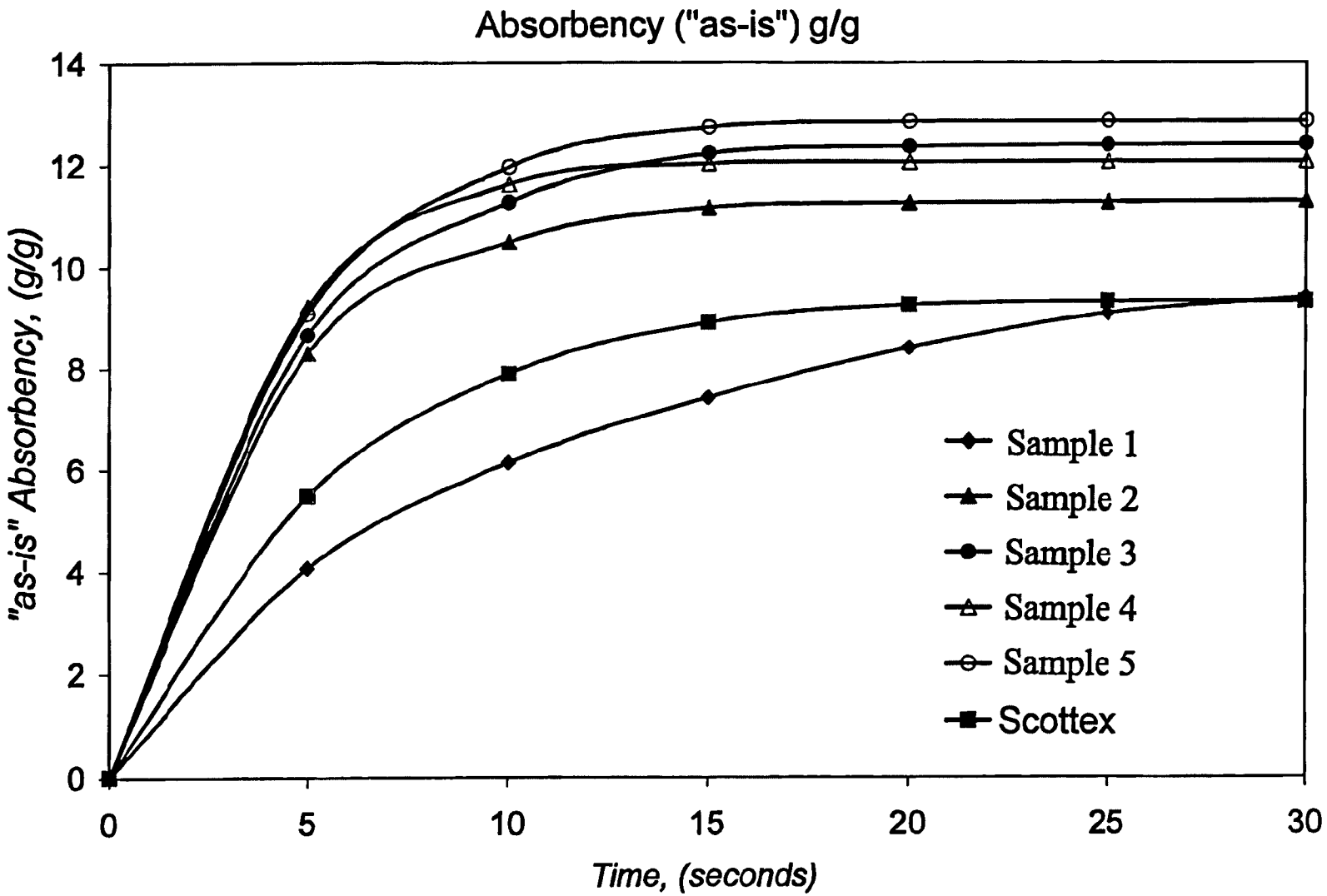
Figure 10:
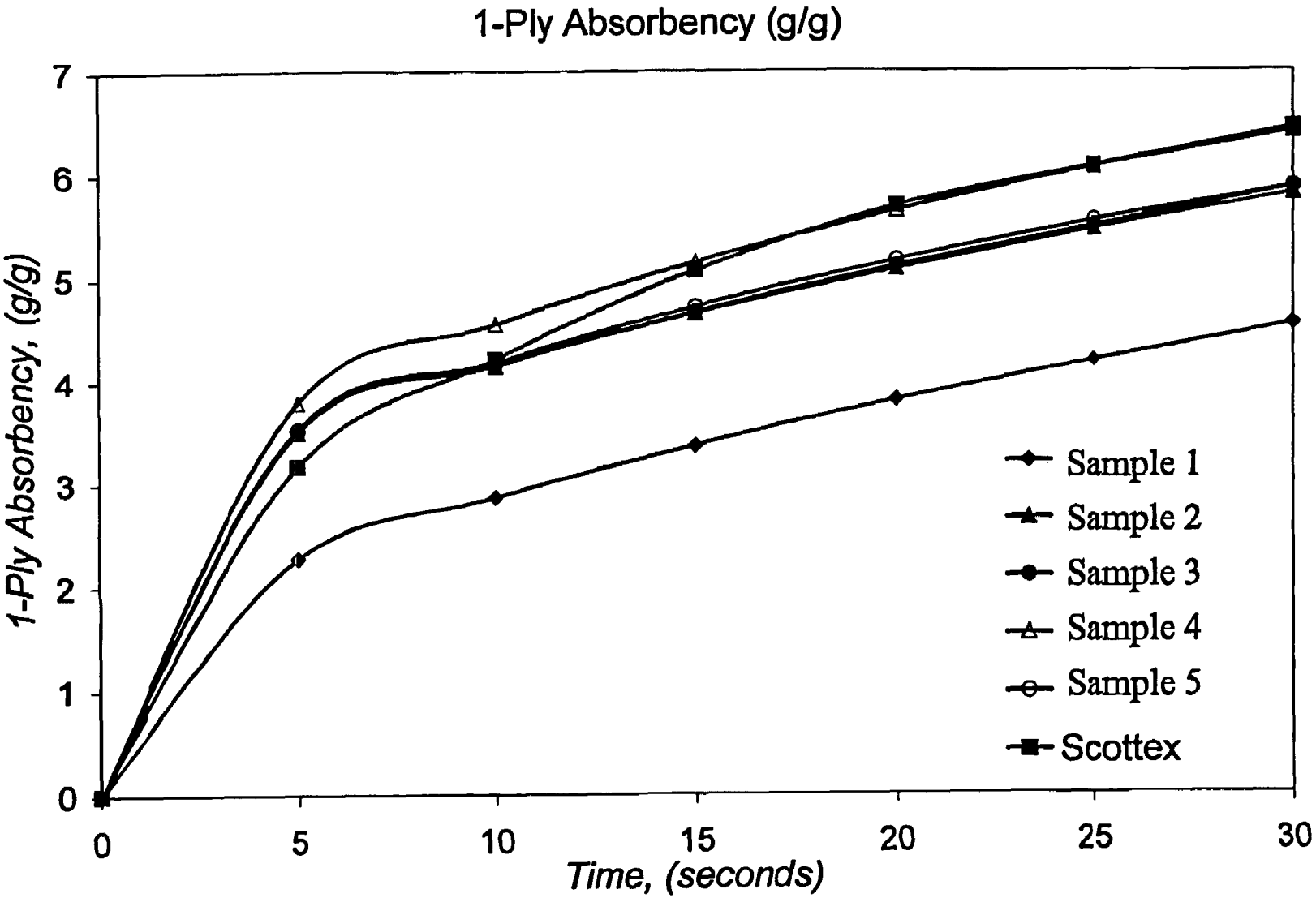
Figure 11:
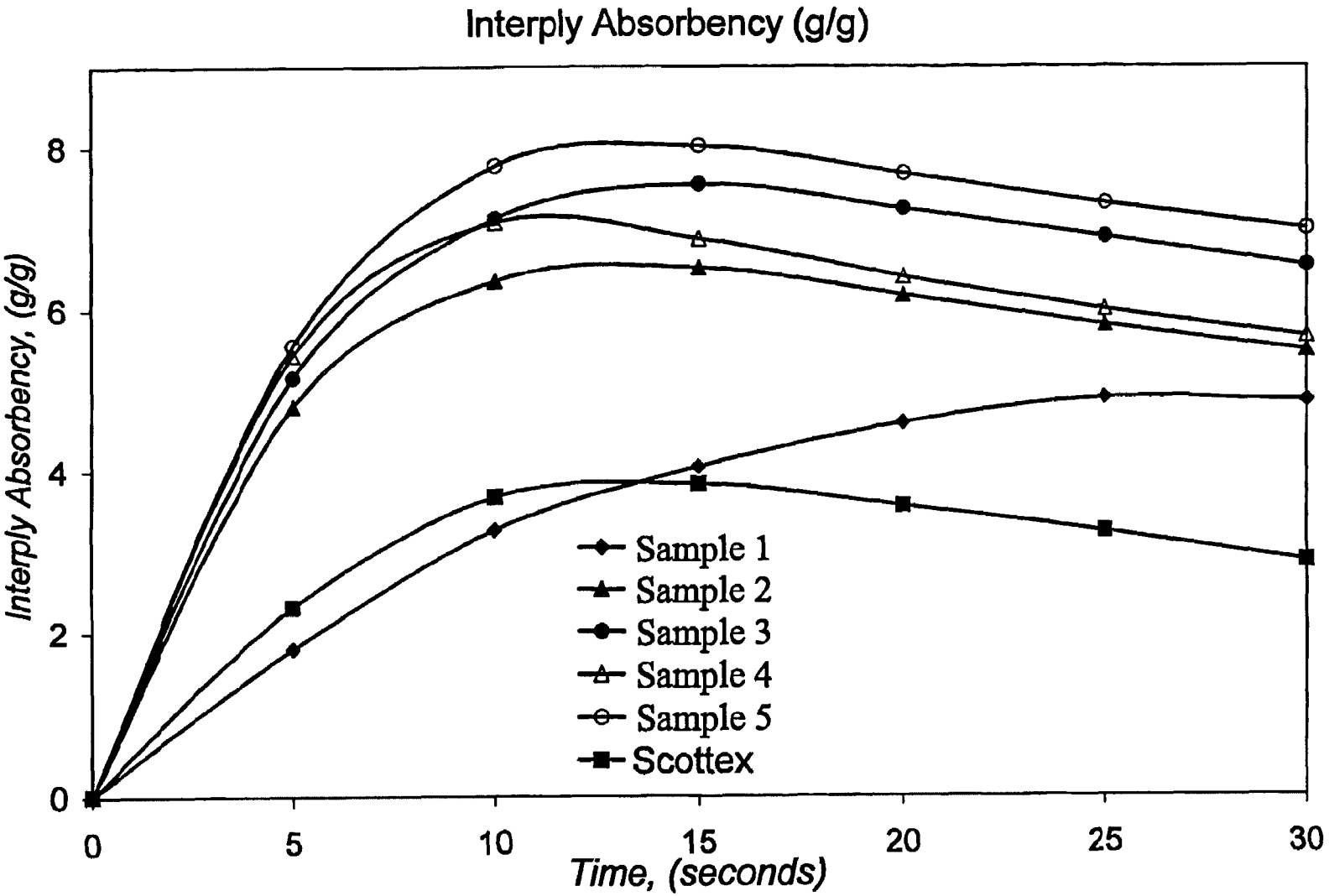
Figure 12:
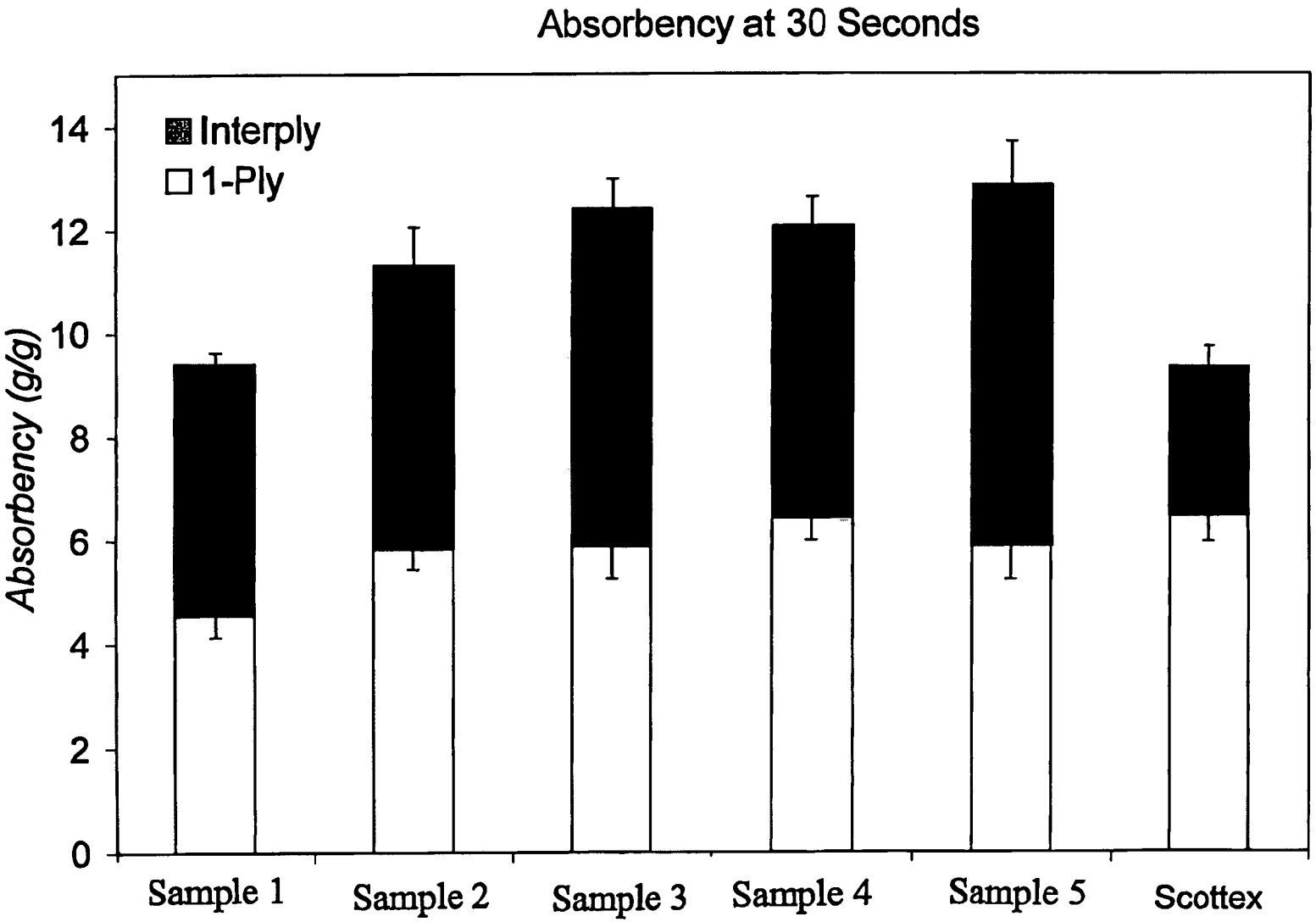
Figure 13:
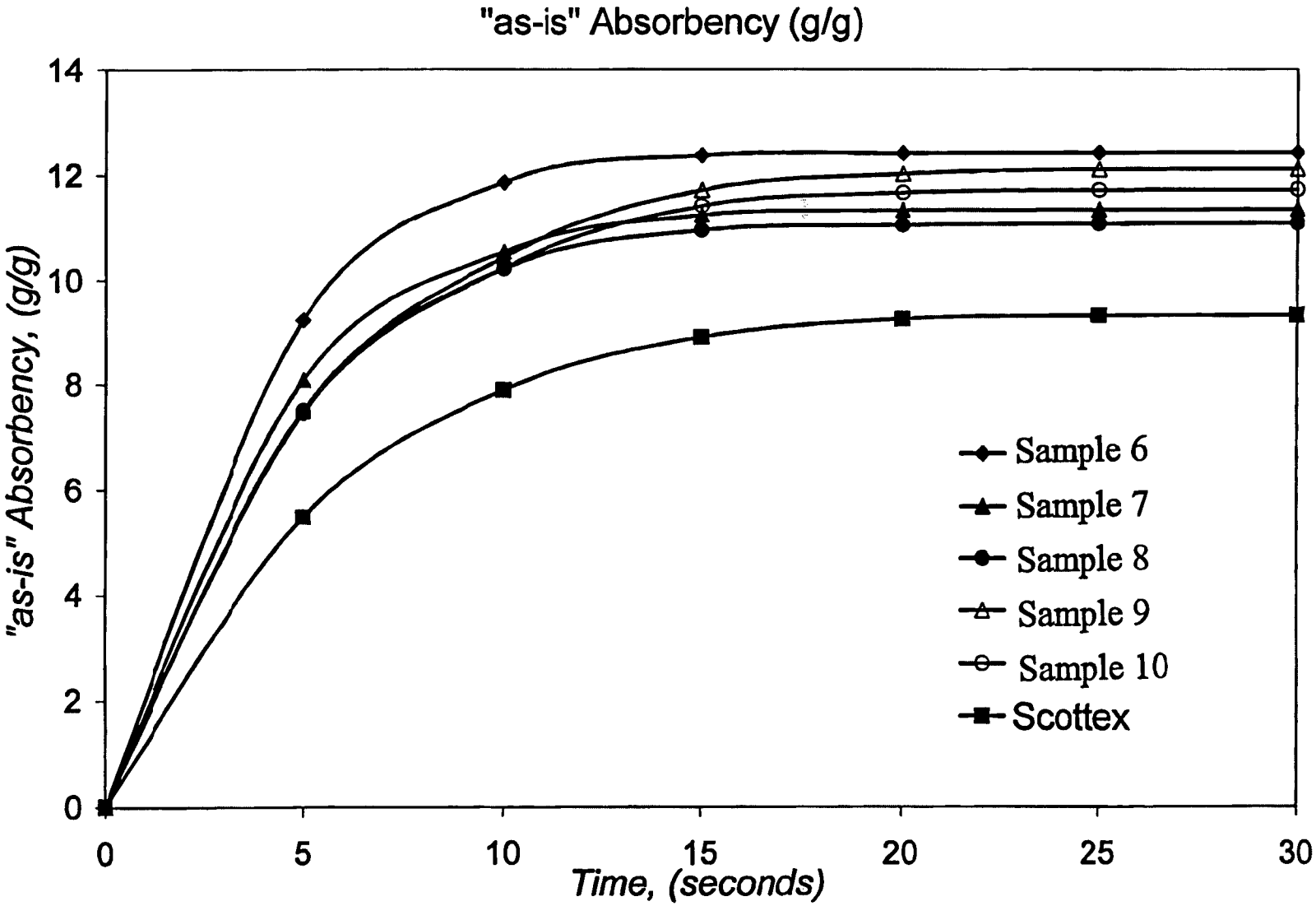
Figure 14:
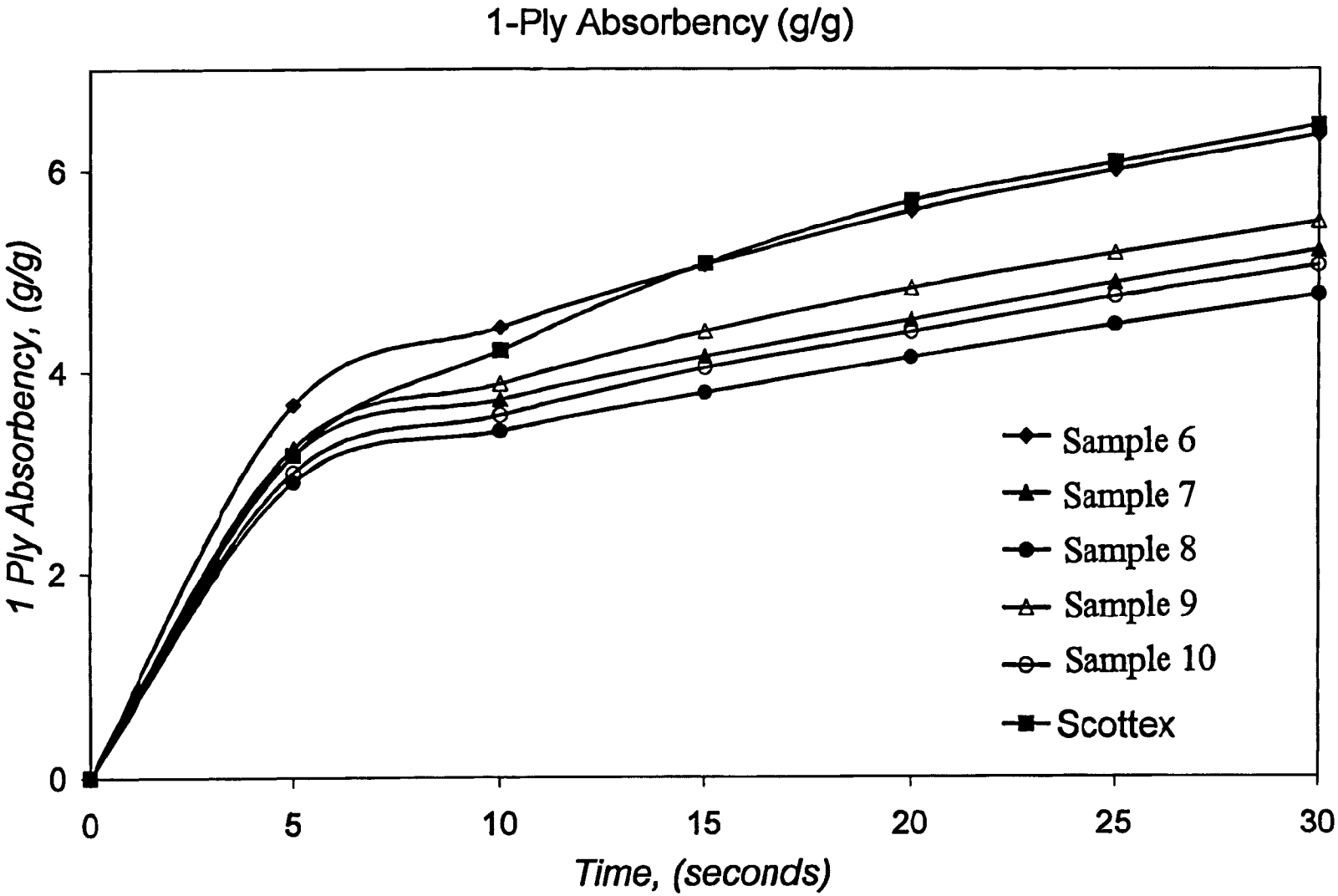
Figure 15:
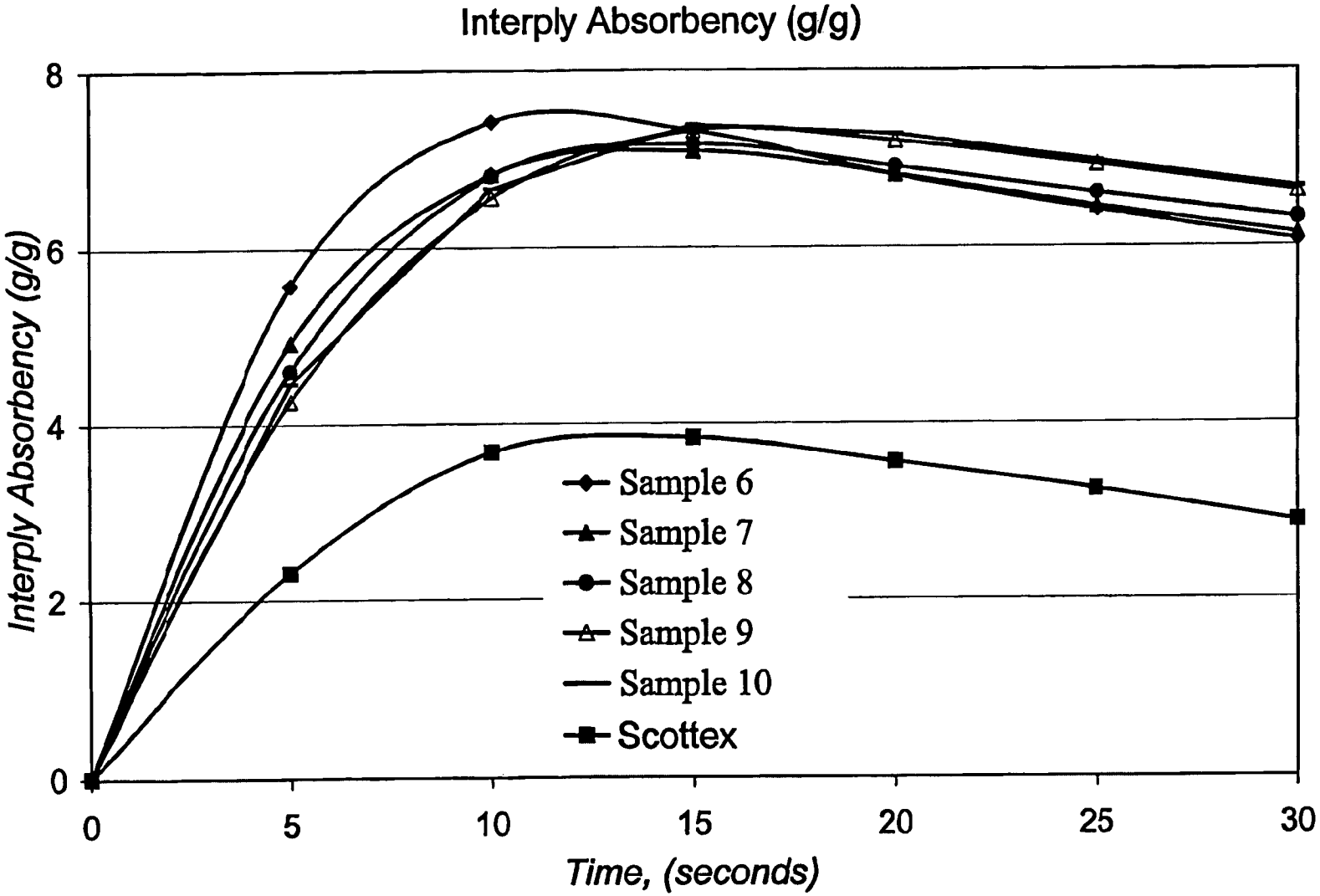
Figure 16:
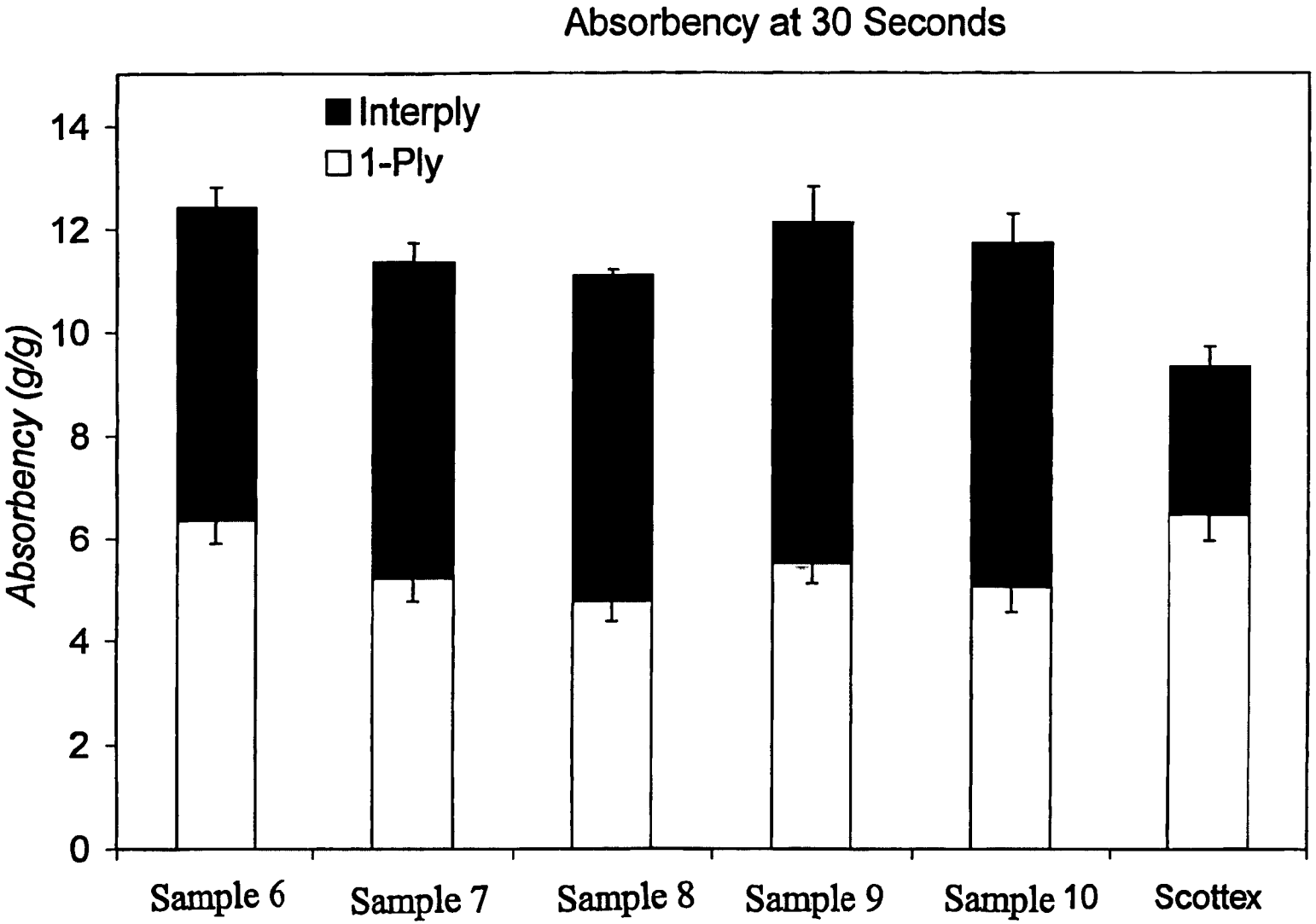
Figure 17:
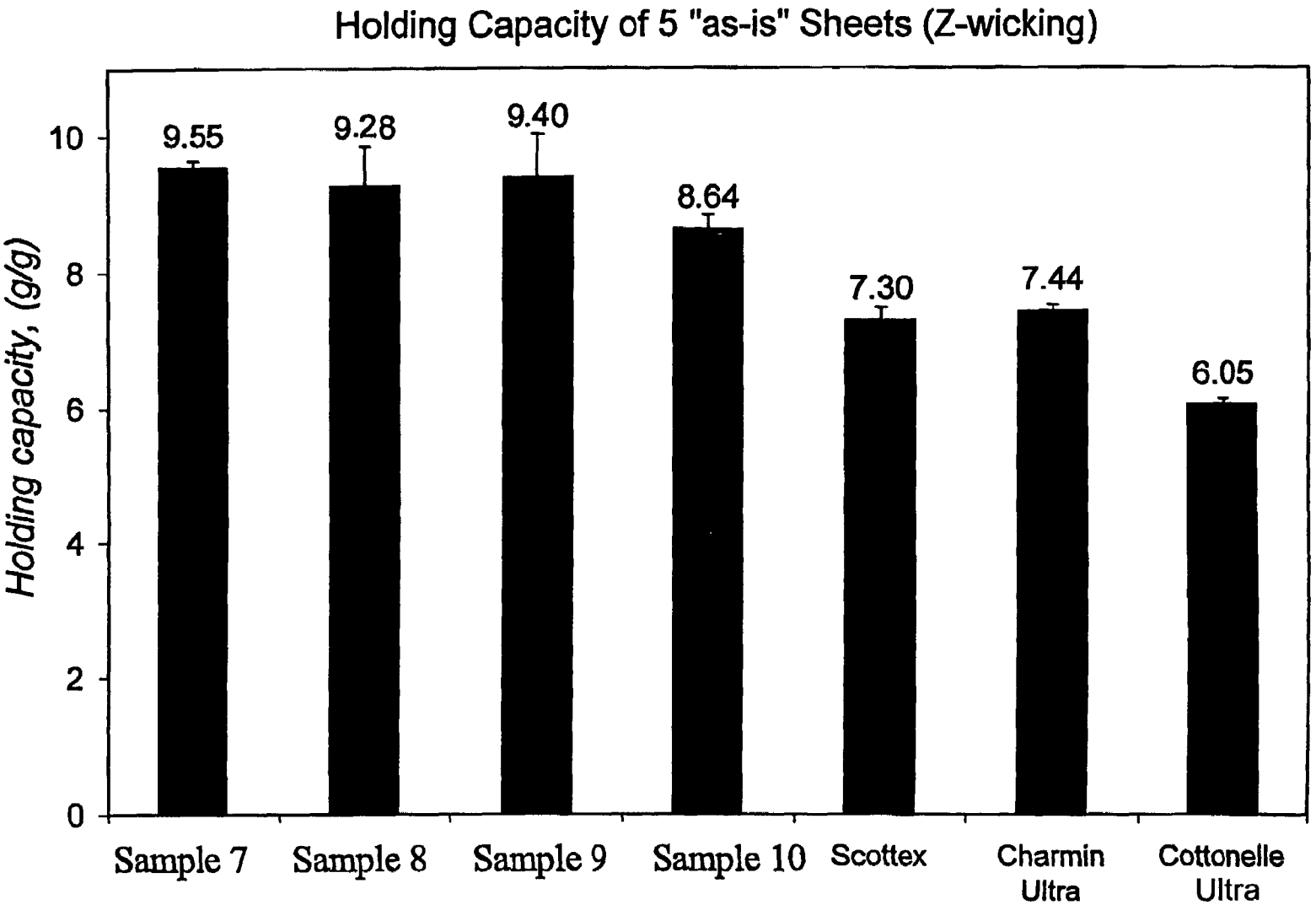

The test method is described above and illustrated in FIG. 4. Each test run was repeated three times, the averages of which are reported below and graphically shown in FIG. 17:

| Sample | Dry Bulk (cc/gm) | Wet Bulk (cc/gm) | Wet/Dry Bulk | Holding Capacity (g/g) |
|---|---|---|---|---|
| Scottex | 11.038 | 7.549 | 0.684 | 7.302 |
| Charmin Ultra | 10.555 | 8.166 | 0.774 | 7.438 |
| Cottonelle Ultra | 8.466 | 6.743 | 0.797 | 6.054 |
| Sample 7 | 21.609 | 10.411 | 0.482 | 9.549 |
| Sample 8 | 18.907 | 9.146 | 0.484 | 9.275 |
| Sample 9 | 18.684 | 8.818 | 0.472 | 9.395 |
| Sample 10 | 18.874 | 8.543 | 0.453 | 8.641 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A multi-ply tissue product comprising:

a first tissue ply containing papermaking fibers;

a second tissue ply containing papermaking fibers, the second ply being attached to the first ply; and wherein each ply has a 3-dimensional topography including raised areas and depressed areas, the raised areas and the depressed areas forming ridges and valleys that generally extend in a first direction on the first ply and in a second direction on the second ply, the first ply and the second ply being combined together such that the first direction of the ridges and valleys on the first ply is offset in relation to the second direction of the ridges and valleys on the second ply, and wherein the tissue product has an interply absorbency per gram of fiber of greater than about 3 g/g at 30 seconds.

2. A multi-ply tissue product as defined in claim 1, wherein the tissue product has an interply absorbency per gram of fiber of greater than about 4 g/g at 30 seconds.

3. A multi-ply tissue product as defined in claim 1, wherein the tissue product has an interply absorbency per gram of fiber of greater than about 5 g/g at 30 seconds.

4. A multi-ply tissue product as defined in claim 1, wherein the tissue product has an interply absorbency per gram of fiber of greater than about 6 g/g at 30 seconds.

5. A multi-ply tissue product as defined in claim 1, wherein the tissue product has an initial rate of absorbency of greater than about 6 g/g after 5 seconds, has a maximum total absorbency of greater than about 10 g/g, and has a total absorbency after 30 seconds of greater than about 10 g/g.

6. A multi-ply tissue product as defined in claim 1, wherein the tissue product has an initial rate of absorbency of greater than about 7 g/g after 5 seconds, has a maximum total absorbency of greater than about 11 g/g, and has a total absorbency after 30 seconds of greater than about 11 g/g.

7. A multi-ply tissue product as defined in claim 1, wherein the tissue product has an initial rate of absorbency of greater than about 8 g/g after 5 seconds, has a maximum total absorbency of greater than about 12 g/g, and has a total absorbency after 30 seconds of greater than about 11 g/g.

8. A multi-ply tissue product as defined in claim 1, wherein the tissue product has an initial rate of absorbency of greater than about 9 g/g after 5 seconds, has a maximum total absorbency of greater than about 12.5 g/g, and has a total absorbency after 30 seconds of greater than about 12 g/g.

9. A multi-ply tissue product as defined in claim 1, wherein the liquid holding capacity is greater than about 8 g/g.

10. A multi-ply tissue product as defined in claim 1, wherein the liquid holding capacity is greater than about 8.5 g/g.

11. A multi-ply tissue product as defined in claim 1, wherein the liquid holding capacity is greater than about 9.5 g/g.

12. A multi-ply tissue product as defined in claim 1, wherein the tissue product has a dry bulk of greater than about 15 cc/gm and a wet bulk of greater than about 8 cc/gm.

13. A multi-ply tissue product as defined in claim 1, wherein the tissue product has a dry bulk of greater than about 17 cc/gm and a wet bulk of greater than about 9 cc/gm.

14. A multi-ply tissue product as defined in claim 1, wherein the tissue product has a basis weight of from about 15 gsm to about 30 gsm.

15. A multi-ply tissue product as defined in claim 1, wherein the tissue product has a basis weight of from about 30 gsm to about 50 gsm.

16. A multi-ply tissue product as defined in claim 1, wherein the first ply is mechanically attached to the second ply

17. A multi-ply tissue product as defined in claim 1, wherein the first ply is attached to the second ply by an adhesive material.

18. A multi-ply tissue product as defined in claim 1, wherein the tissue product only contains two plies.

19. A multi-ply tissue product as defined in claim 1, wherein the tissue product comprises a bath tissue having a geometric mean tensile strength of less than about 1000 g per 3 inches.

20. A two-ply tissue product comprising:

a first tissue ply containing papermaking fibers;

a second tissue ply containing papermaking fibers, the second ply being attached to the first ply;

wherein the tissue product has an initial rate of absorbency of greater than about 6 g/g after five seconds, a maximum total absorbency of greater than about 10 gig, a total absorbency after 30 seconds of greater than about 10 g/g, and a liquid holding capacity of greater than about 8 g/g and;

wherein each ply has a 3-dimensional topography including raised areas and depressed areas, the raised areas and the depressed areas forming ridges and valleys that generally extend in a first direction on the first ply and in a second direction on the second ply, the first ply and the second ply being combined together such that the first direction of the ridges and valleys on the first ply is offset in relation to the second direction of the ridges and valleys on the second ply and wherein the tissue product has an interply absorbency per gram of fiber of greater than 3 g/g at 30 seconds.

21. A two-ply tissue product as defined in claim 20, wherein the tissue product has an initial rate of absorbency of greater than about 7 g/g after 5 seconds, a maximum total absorbency of greater than about 11 g/g, a total absorbency after 30 seconds of greater than about 11 g/g and a liquid holding capacity of greater than about 8.5 g/g.

22. A two-ply tissue product as defined in claim 20, wherein the tissue product has an initial rate of absorbency of greater than about 9 g/g after 5 seconds, a maximum total absorbency of greater than about 12 g/g, a total absorbency after 30 seconds of greater than about 12 g/g and a liquid holding capacity of greater than about 9.5 g/g.

23. A two-ply tissue product as defined in claim 20, wherein the tissue product has an interply absorbency per gram of fiber of greater than about 5 g/g at 30 seconds.

24. A two-ply tissue product as defined in claim 20, wherein the tissue product has an interply absorbency per gram of fiber of greater than about 6 g/g at 30 seconds.

25. A two-ply tissue product as defined in claim 20, wherein the tissue product has a basis weight of from about 15 gsm to about 30 gsm.

26. A two-ply tissue product as defined in claim 20, wherein the tissue product has a basis weight of from about 30 gsm to about 50 gsm.

27. A two-ply tissue product as defined in claim 20, wherein the first tissue ply and the second tissue ply comprise uncreped through-air dried webs.

28. A multi-ply tissue product comprising:

a first tissue ply containing papermaking fibers, the first tissue ply comprising an uncreped through-air dried web, the first tissue ply including ridges and valleys that generally extend in a first direction;

a second tissue ply containing papermaking fibers, the second tissue ply comprising an uncreped through-air dried web, the second tissue ply having ridges and valleys that generally extend in a second direction, the second ply being attached to the first ply in a manner such that the first direction of the ridges and valleys on the first ply is offset to the second direction of the ridges and valleys on the second ply; and wherein the tissue product has an interply absorbency per gram of fiber of greater than about 3 g/g at 30 seconds.

29. A multi-ply tissue product as defined in claim 28, wherein the tissue product has an interply absorbency per gram of fiber of greater than about 5 g/g, has an initial rate of absorbency of greater than about 7 g/g after 5 seconds, has a maximum total absorbency of greater than about 11 g/g, and has a total absorbency after 30 seconds of greater than about 10 g/g.

30. A multi-ply tissue product as defined in claim 28, wherein the tissue product has an interply absorbency per gram of fiber of greater than about 6 g/g, has an initial rate of absorbency of greater than about 9 g/g after about 5 seconds, has a maximum total absorbency of greater than about 12 g/g, and has a total absorbency after 30 seconds of greater than about 12 g/g.

31. A multi-ply tissue product as defined in claim 28, wherein the tissue product has a dry bulk of greater than about 17 cc/gm and a wet bulk of greater than about 9 cc/gm.

32. A multi-ply tissue product as defined in claim 28, wherein the tissue product has a basis weight of from about 15 gsm to about 30 gsm.

33. A multi-ply tissue product as defined in claim 28, wherein the tissue product has a basis weight of from about 30 gsm to about 50 gsm.

34. A multi-ply tissue product as defined in claim 28, wherein the tissue product comprises a bath tissue and wherein the tissue product is wound into a roll.

35. A multi-ply tissue product as defined in claim 28, wherein the tissue product only contains two plies.

36. A multi-ply tissue product as defined in claim 28, wherein the tissue product comprises a bath tissue having a geometric mean tensile strength of less than about 1000 g per 3 inches.

* * * * *

UNITED STATES PATENT AND TRADEMARK OFFICE

CERTIFICATE OF CORRECTION

PATENT NO. : 7,524,399 B2
APPLICATION NO. : 11/020553
DATED : April 28, 2009
INVENTOR(S) : Hermans et al.

It is certified that error appears in the above-identified patent and that said Letters Patent is hereby corrected as shown below:

Col. 19 line 42
Claim 20, line 7 reads "greater than about 10 glg" should read --greater than about 10 g/g--

Signed and Sealed this

Twenty-ninth Day of December, 2009

David J. Kappos

David J. Kappos
*Director of the United States Patent and Trademark Office*